US007308215B2

(12) United States Patent
Watanabe

(10) Patent No.: US 7,308,215 B2
(45) Date of Patent: Dec. 11, 2007

(54) IMAGE HEATING APPARATUS WITH ENDLESS BELT OPERATION IN A NIP

(75) Inventor: Osamu Watanabe, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 11/288,087

(22) Filed: Nov. 29, 2005

(65) Prior Publication Data

US 2006/0127144 A1 Jun. 15, 2006

(30) Foreign Application Priority Data

Dec. 10, 2004 (JP) ..... 2004-358639

(51) Int. Cl.
*G03G 15/20* (2006.01)

(52) U.S. Cl. ..... 399/67; 399/82; 399/329

(58) Field of Classification Search ..... 399/67, 399/329, 328, 320, 82, 43; 219/216
See application file for complete search history.

(56) References Cited

U.S. PATENT DOCUMENTS

| | | | | |
|---|---|---|---|---|
| 5,525,775 | A | 6/1996 | Setoriyama et al. | 219/216 |
| 6,681,095 | B1 * | 1/2004 | Tsuda | 399/329 X |
| 2005/0220507 | A1 * | 10/2005 | Uehara et al. | 399/329 |

FOREIGN PATENT DOCUMENTS

| | | | |
|---|---|---|---|
| JP | 03-011382 A | * | 1/1991 |
| JP | 4-44075 | | 2/1992 |
| JP | 6-318001 | | 11/1994 |
| JP | 10-321352 | | 12/1998 |

* cited by examiner

*Primary Examiner*—Sophia S. Chen
(74) *Attorney, Agent, or Firm*—Fitzpatrick, Cella, Harper & Scinto

(57) ABSTRACT

A fixing apparatus has a belt-shaped rotary member, a pressure member urged against the rotary member to form a nip portion, and a heater for the rotary member. A portion of the rotary member is maintained so that the belt portion has a radius of curvature smaller than an inner diameter of the rotary member, and after the apparatus is stopped a predetermined time, when the rotary member is rotated again, a control sequence is carried out in which the portion of the rotary member including the smaller radius of curvature is conveyed and positioned in the nip portion and the heating is performed while rotation of the rotary member is stopped, or, after the apparatus is stopped more than a predetermined time, when the rotary member is rotated again, a control sequence is carried out while conveying the portion of the rotary member including the smaller radius of curvature through the nip portion once at a speed smaller than a normal conveying speed.

7 Claims, 17 Drawing Sheets

HEATER FRONT SURFACE SIDE

HEATER BACKT SURFACE SIDE a-b: STREAK-LIKE GLOSS UNEVENNESS OWING TO BELT BENDING MARK

IMAGE HEATING APPARATUS WITH ENDLESS BELT OPERATION IN A NIP

BACKGROUND OF THE INVENTION

1. Field of the Invention

The present invention relates to an image heating apparatus for heating an image formed on a recording material by using an electrophotographic system or an electrostatic recording system. Such an image heating apparatus can be used, for example, as a fixing apparatus in a copier, a printer, a facsimile or the like.

2. Related Background Art

In image forming apparatuses such as electrophotographic copiers, printers or facsimiles, after an electrostatic latent image is formed on a photosensitive member, the electrostatic latent image is developed as a toner image which is then fixed onto a paper by thermally fusing and pressurizing the toner image. A fixing apparatus for fixing the toner image onto a recording material (paper or recording medium) is incorporated in such an image forming apparatus.

Japanese Patent Application Laid-open No. H06-318001 (1994) discloses a fixing apparatus of belt type (belt fixing apparatus). This belt fixing apparatus comprises an endless fixing belt, a fixing roller, a heating roller and a pressure roller. The heating roller and the fixing roller are disposed in parallel with each other and the fixing belt extends between and is wound around the heating roller and the fixing roller. The pressure roller is disposed in parallel with the fixing roller with the interposition of the fixing belt therebetween and is biased toward the fixing roller. As a result, pressure is generated between the fixing roller and the fixing belt. When the pressure roller is rotated, the fixing belt wound around the heating roller and the fixing roller is driven. A main heating source is arranged within the heating roller and an auxiliary heating source is arranged within the pressure roller. A recording material carrying a toner image is passed through an area (nip portion) where a portion of the fixing belt is pinched between the pressure roller and the fixing roller. While the recording material being passed through the nip portion, heat is applied to the recording material from the fixing belt and pressure is applied to the recording material from the pressure roller. In this case, the recording material is also subjected to auxiliary heat from the pressure roller. By the heat and the pressure applied to the recording material being passed through the nip portion, the toner image or non-fixed image is fixed onto the recording material.

Further, Japanese Patent Application Laid-open No. H04-44075 (1992) proposes a fixing apparatus of belt heating type for performing the heating via a belt having small heat capacity, as a system (on-demand system) having a high heat transferring efficiency and fast rising-up of the apparatus. In this apparatus, a heat resistive resin belt (fixing belt) as a heating rotary member is closely urged against heating means (heating heater) by a pressurizing rotary member (elastic) roller and is slidingly conveyed thereby, and a recording material as a heated material carrying a non-fixed image is introduced into a nip portion defined by the heating means and the pressurizing member with the interposition of the belt so that the recording material is conveyed together with the heat resistive resin belt. In this way, the non-fixed image is fixed onto the recording material as a permanent image by heat from the heating means via the belt and a pressurizing force of the nip portion.

In recent development of colorization of electrophotographic techniques, it has been requested for the fixing member contacted with the recording material to provide soft fixing. In the conventional fixing apparatuses of belt heating type, it is pointed out that, due to rigidity of a surface layer comprised of mold releasing resin such as fluororesin, toner particles may be crushed thereby to deteriorate a resolving power of the image and that, during color image fixing, since plural color layers are laminated, poor color mixing may occur. Provision of an elastic belt in which an elastic layer is provided between a base layer and a surface layer as means for solving these problems has been proposed in Japanese Patent Application Laid-open No. H10-321352 (1998).

In view of recent energy saving, it is known to provide a method in which consumption of electric power of the heating means is reduced by increasing thermal conductivity of the belt base layer by using metal such as nickel as the base layer of the belt in place of the heat resistive resin and to provide a technique in which a fixing property is further improved and further high speed can be achieved and uniformity of a temperature in a longitudinal direction of the nip portion is also enhanced, by increasing thermal conductivity of the belt base layer by using metal.

However, in the fixing apparatus of belt heating type, after the fixing operation, if the fixing apparatus is not used within a predetermined time period after the driving of the fixing belt is stopped, at a contact area between the fixing belt and the heating roller, the base layer and the elastic layer of the fixing belt are cooled and hardened in a condition that these layers are deformed. As a result that, when the fixing belt is used again, the fixing belt cannot be restored from the deformed condition quickly. Particularly when a diameter of the heating roller is reduced in order to achieve compactness of the apparatus, a winding mark (referred to as "winding curl" hereinafter) of the fixing belt is generated. Consequently, when the image is formed firstly in a day or when the image is formed after a long inoperative time, glossy unevenness and/or streak(s) is generated in the image due to such winding mark or a protruded portion is generated on the fixing belt due to the winding mark before the belt is introduced into the nip portion, with the result that poor image such as scattering of the image would be occurred during the fixing.

Further, in the above-mentioned fixing apparatus of belt heating type, curvatures of the rising-up portions of the belt at both ends of the nip portion are increased. As a result, if the apparatus is not used within the predetermined time period after the driving of the fixing belt is stopped after the fixing operation, bending marks may be formed on belt portions at the both ends of the nip portion having great curvature, with the result that, in response to such belt bending, glossy unevenness and stripe(s) may occur in the image.

SUMMARY OF THE INVENTION

An object of the present invention is to provide an image heating apparatus which can correct deformation in a belt.

More particularly, an object of the present invention is to provide an image heating apparatus comprising an endless belt for heating an image on a recording material at a nip, supporting means for rotatably supporting the belt, and nip forming means for forming the nip between the belt and the nip forming means, and heating means for heating a portion of the belt located in the nip, wherein said apparatus is operable a mode for performing heating process in a condition that a portion of the belt supported by the supporting means is shifted into the nip and stopped therein.

A further object of the present invention is to provide an image heating apparatus comprising an endless belt for heating an image on a recording material at a nip, supporting means for rotatably supporting the belt, and nip forming means for forming the nip between the belt and the nip forming means, and heating means for heating a portion of the belt located in the nip, wherein said apparatus is operable a mode for correcting deformation of the belt by heating, in the nip, a portion of the belt deformed by the supporting means.

The other objects of the present invention will be apparent from the following detailed explanation of the invention made with reference to the accompanying drawings.

DESCRIPTION OF THE PREFERRED EMBODIMENTS

First Embodiment (1) Example of Image Forming Apparatus

Figure 1:
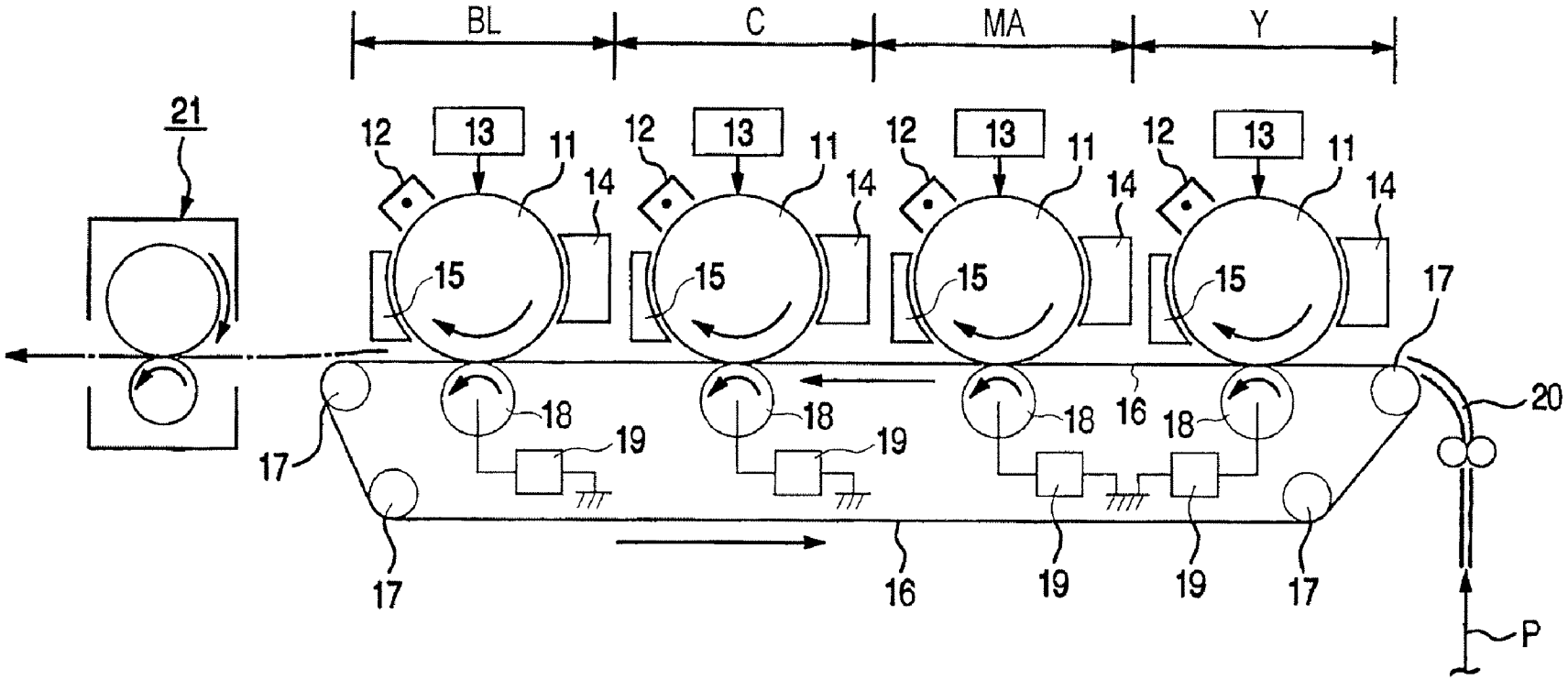
FIG. 1 is a schematic constructional view of an image forming apparatus according to a first embodiment of the present invention.

FIG. 1 is a schematic constructional view showing an example of an image forming apparatus to which a fixing apparatus according to the present invention is mounted. This image forming apparatus is a full color printer of tandem type using an electrophotographic process.

Y, MA, C and B: denote four (first to fourth) color toner image forming stations arranged from right to left in order in FIG. 1. Each of the stations Y, MA, C and BL is an electrophotographic processing mechanism comprising an electrophotographic photosensitive member 11 of rotary drum type as an image bearing member, a charging device 12, an exposure device 13 such as a laser scanner or an LED array, a developing device 14 and a cleaning device 15. The photosensitive member 11 is rotatingly driven at a predetermined peripheral speed in a clockwise direction shown by the affow.

The first color toner image forming station Y serves to form a toner image including a yellow component of a full color image on a surface of the photosensitive member 11. The second color toner image forming station MA serves to form a toner image including a magenta component of the full color image on the surface of the photosensitive member 11. The third color toner image forming station C serves to form a toner image including a cyan component of the full color image on the surface of the photosensitive member 11. The fourth color toner image forming station BL serves to form a black toner image on the surface of the photosensitive member 11. Since the principle and process for forming the toner image in each color toner image forming station are well-known, explanation thereof will be omitted.

A transfer belt 16 is wound around and tensioned by a plurality of support rollers 17 and is disposed below the first to fourth color toner image forming stations Y, MA, C and BL to extend throughout these stations. The transfer belt 16 is rotatingly driven in an anti-clockwise direction shown by the arrow at a peripheral speed corresponding to the peripheral speed of the photosensitive member 11.

Transfer rollers 18 are urged against lower sides of the corresponding photosensitive members 11 with the interposition of the transfer belt 16 to form transfer nip portions at the first to fourth color toner image forming stations Y, MA, C and BL. Transfer bias applying power sources 19 are associated with the corresponding transfer rollers 18 and each serves to apply predetermined voltage having polarity opposite to charging polarity of toner as transfer bias at predetermined control timing.

A sheet feeding path 20 serves to feed a recording material (transferring matenal, or paper) P separated and fed from a sheet feeding mechanism (not shown) toward an end of the transfer belt 16 at the first color toner image forming station Y. The transfer belt 16 holds the fed recording material P by electrostatic absorption or by a chuck and conveys the recording material through the transfer nip portions of the first to fourth visual color toner image forming stations Y, MA, C and BL in order. In this way, a yellow toner image, a magenta toner image, a cyan toner image and a black toner image are transfeffed in order on a surface of the same recording material P in a superimposed and aligned fashion, thereby forming a full color toner image.

The recording material leaving the transfer nip portion of the fourth color toner image forming station B is separated from the transfer belt 16. Then, the recording material is introduced into a fixing apparatus 21 as an image heating apparatus, where non-fixed toner images are heated and pressurized to be fixed onto the recording material. Thereafter, the recording material is discharged out of the image forming apparatus.

Figure 2:
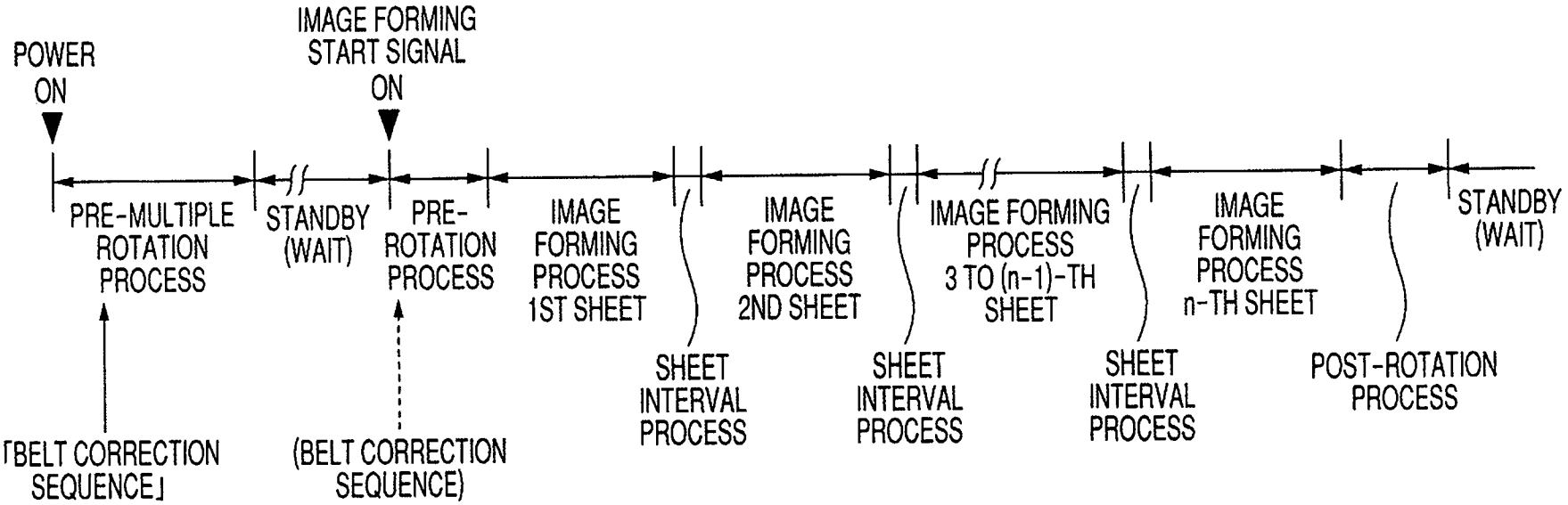
FIG. 2 is an explanatory view showing operating processes of the image forming apparatus.

FIG. 2 is a view showing operating processes of the image forming apparatus according to the illustrated example.

a) Pre-Multiple Rotation Process

This is an initiating (starting) operation period (warming period) of the image forming apparatus. When a main power supply switch is turned ON, a main motor (not shown) of the image forming apparatus is driven to rotate the photosensitive members and to carry out preparing operations of required process equipments.

b) Stand-By

After the predetermined initiating period is finished, the main motor is temporarily stopped to stop the rotation of the photosensitive members, and the image forming apparatus maintained in a stand-by (wait) condition until an image forming start signal is inputted.

c) Pre-Rotation Process

In this pre-rotation process, when the image forming start signal is inputted, the main motor is driven again to rotate the photosensitive members again, thereby causing the image forming apparatus to carry out predetermined image forming pre-operations for a while.

d) Image Forming Process

When the predetermined pre-rotation process is finished, then, image forming processes for the rotating photosensitive members are carried out, and then, the recording material P to which the toner images were transferred to the fixing apparatus 21, thereby performing the image forming process for a first sheet.

In case of a continuous image forming mode, the image forming processes corresponding to the desired number n of sheets are repeated in order.

e) Sheet Interval Process

A sheet interval process is a period during which the recording material does not pass through the transfer nip portion in the continuous image forming mode, which period corresponds to duration from when a trailing end of one recording material P leaves the transfer nip portion of the first color toner image forming station Y and till when a leading end of a next recording material P reaches said transfer nip portion.

f) Post-Rotation Process

In this post-rotation process, after the image forming process for the last n-th sheet is finished, the main motor continues to be driven to continue the rotation of the photosensitive members for a while, thereby causing the image forming apparatus to carry out predetermined post-operations.

g) Stand-By

When the predetermined post-rotation process is finished, the main motor is stopped to stop the photosensitive members, and the image forming apparatus is maintained in the stand-by condition until a next image forming start signal is inputted.

Immediately after the pre-multiple rotation process, if the image forming start signal is inputted, subsequently, the pre-rotation process is carried out, and then, the image forming process is carried out. Further, in a case where the image is formed on a single sheet, after the image forming process is finished, the image forming apparatus carries out the post-rotation process and enters into the stand-by condition.

During the pre-multiple rotation process and/or the pre-rotation process, a "belt correction sequence" which will be fully described later in the following item (3) is carried out in accordance with the stop time of the apparatus.

(2) Fixing apparatus 21

Figure 3:
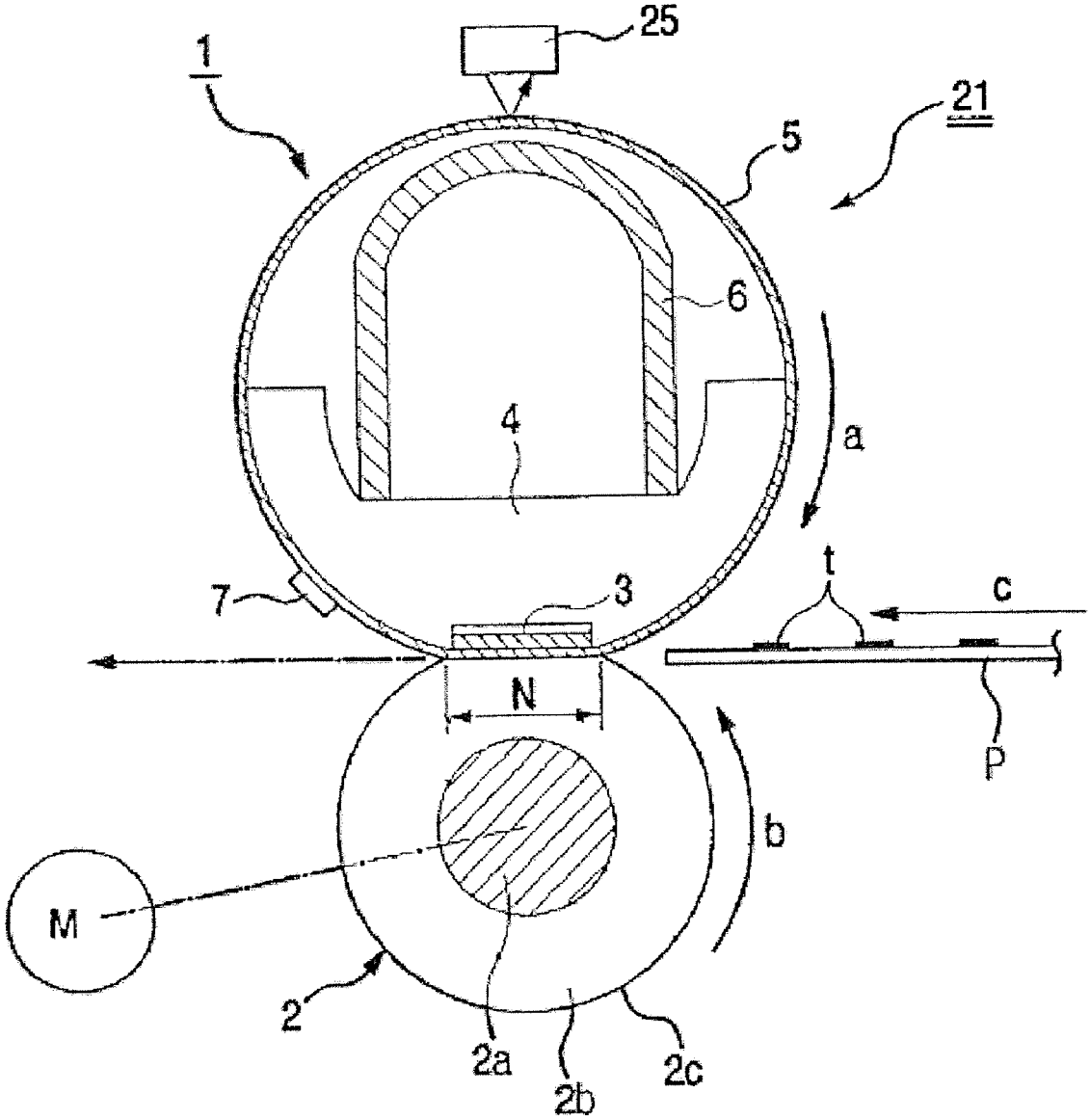
FIG. 3 is a schematic constructional view of a fixing apparatus of belt heating type according to the first embodiment.

FIG. 3 is an enlarged schematic sectional view of the fixing apparatus 21 as an image heating apparatus. The fixing apparatus 21 according to the illustrated embodiment is a belt heating type fixing apparatus of pressure roller driving type using a flexible endless heat resistive elastic belt (heating rotary member).

The fixing apparatus includes a heating assembly 1 as a fixing member, and a heat resistive elastic pressure roller 2 as a pressurizing member, which members are urged against with each other to form a fixing nip portion (abutting nip portion: referred to merely as "nip portion" hereinafter) N.

The heating assembly 1 as the fixing member comprises heating means (heating member) 3 for heating a belt, a thermal insulation stay holder 4 as support means for holding the heating means and for rotatably supporting a heat resistive elastic belt (referred to merely as "belt" hereinafter) 5, and a rigid stay 6 disposed within the thermal insulation stay holder 4 and having an inverted U-shaped cross-section.

The heat resistive elastic pressure roller 2 as the pressurizing member comprises a metal core 2*a*, and an elastic layer 2*b* formed around the metal core by foaming heat resistive rubber such as silicone rubber or fluororubber, and a mold releasing layer 2*c* made of PFA, PTFE or FEP may be provided on the layer 2*b*. The pressure roller 2 according to the illustrated embodiment has a diameter of 20 mm.

The heating assembly 1 as the fixing member and the heat resistive elastic pressure roller 2 as the pressurizing member are aligned with each other in a vertical direction, and the pressure roller 2 is biased toward the heating assembly 1 by pressurizing means (not shown) in opposition to an elastic force of the elastic layer 2*b*, and pressurization is controlled at both longitudinal ends of the heating assembly 1 and the pressure roller 2 in such a manner that a nip portion N having a width required for thermal fixing is formed between a lower surface of the heating means 3 of the heating assembly 1 and the pressure roller 2 with the interposition of the belt 5.

The pressure roller 2 is rotatingly driven by drive means M in an anti-clockwise direction shown by the arrow b. In synchronous with the rotation of the pressure roller 2, the belt 5 is driven around the thermal insulation stay holder 4 in a clockwise direction shown by the arrow a in such a manner that an inner surface of the belt is contacted with and slid on the lower surface of the heating means 3 at the nip portion N.

In the nip portion N, the recording material P as heated material carrying a non-fixed toner image t is introduced between the belt 5 and the pressure roller 5 and is conveyed while being pinched between the belt and the pressure roller. The recording material is conveyed in a direction c.

Figure 4:
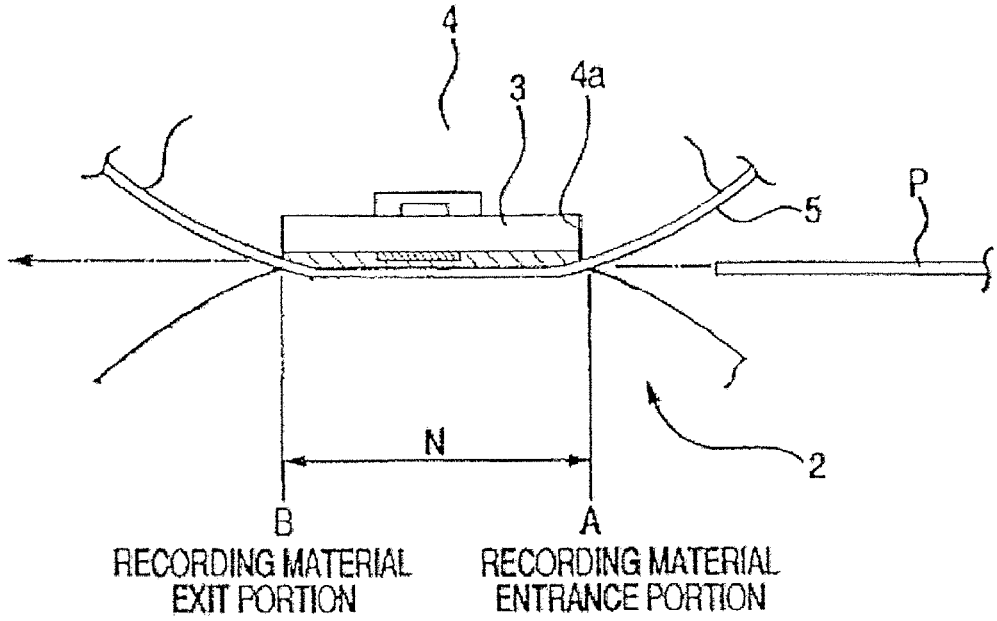
FIG. 4 is an enlarged schematic view of a heater part of the fixing apparatus according to the first embodiment.

In the illustrated embodiment, the heating means 3 is a ceramic heater, and the heater 3 is fixedly supported on the outer surface of the thermal insulation stay holder 4 at a position corresponding to the nip portion N. FIG. 4 is an enlarged schematic view of a part of the heater 3. The heater 3 heats the inner surface of the belt at the position corresponding to the nip portion N, with the result that, while the recording material P is being pinched between and conveyed by the belt 5 and the pressure roller 5 at the nip portion N, the heat is transferred to the recording material P, thereby fusing the toner image t and fixing the toner image onto the recording material P.

Figure 5A:
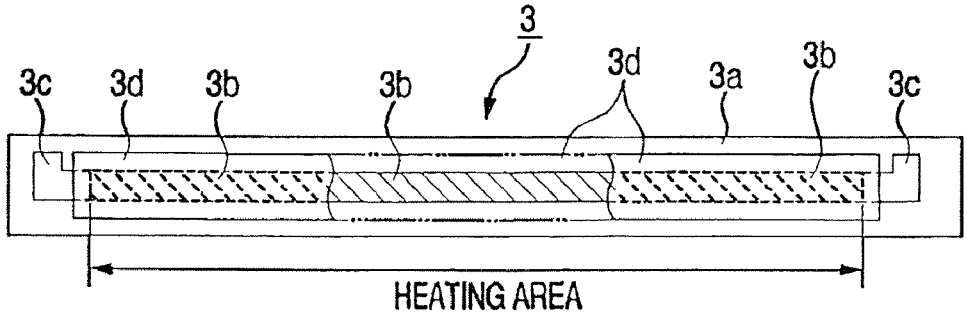
FIGS. 5A and 5B are constructional views of a heater of the fixing apparatus according to the first embodiment.
Figure 5B:
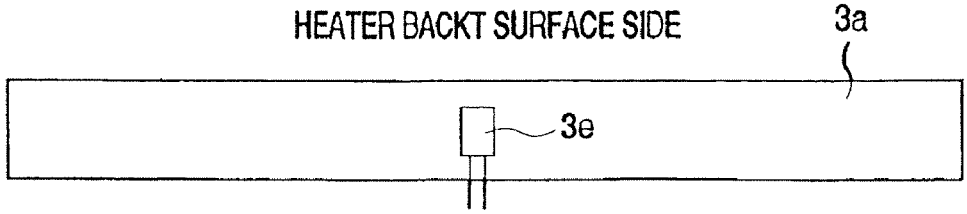

FIGS. 5A and 5B are constructional views showing an example of the ceramic heater 3 as the heating means, where FIG. 5A is a partial fragmental schematic plan view at a front surface side of the heater and FIG. 5B is a schematic plan view at a back surface side of the heater.

The heater 3 is constituted by the following elements:

a: a ceramic substrate 3*a* (having a thickness of about 0.64 nim) made high insulative material such as alumina, aluminum nitride or silicon carbonate carbide and being elongated in a longitudinal direction perpendicular to a conveying direction of the recording material;

b: a power supply heat generating resistance layer 3*b* made of, for example, Ag/Pb (silver palladium), $RuO_2$ or $Ta_2N$ and formed by coating in the form of a line or a strip having a thickness of about 10 μm and a width of about 1 to 5 mm by means of screen printing along the longitudinal direction on a front surface of the substrate 3*a;* c: electrode portions 3*c* made of Ag/Pt (silver platinum) and electrically connected to both longitudinal ends of the power supply heat generating resistance layer 3*b;* d: an insulative protection layer 3*d* provided on a surface of the power supply heat generating resistance layer 3*b* and formed from a thin glass coat layer or the like capable of achieving electrical insulation and enduring sliding contact to the belt 5; and e: a temperature sensing element 3*e* such as a thermistor provided on a back surface of the substrate 3*a*.

The heater 3 is fixedly supported by fitting it into a fitting recess 4*a* (FIG. 4) formed in the outer surface of the thermal insulation stay holder 4 at a predetermined position.

Figure 6:
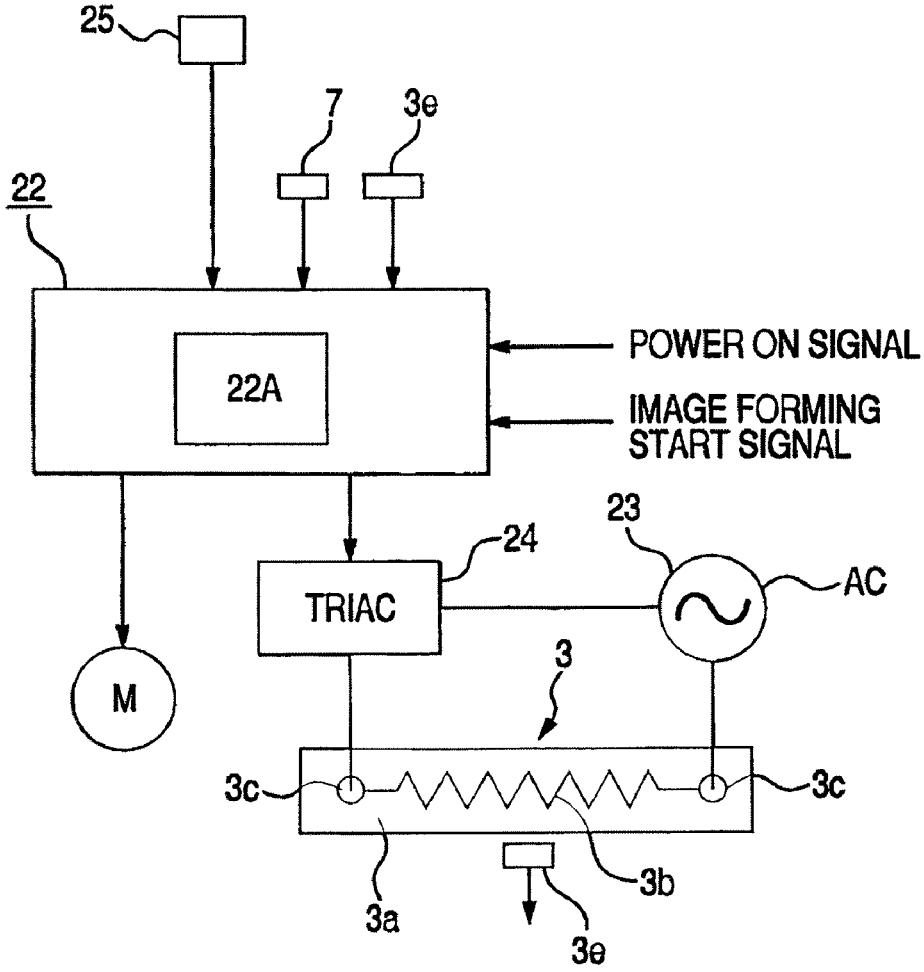
FIG. 6 is a block diagram of a control system of the fixing apparatus according to the first embodiment.

FIG. 6 is a block diagram of a control system of the fixing apparatus. The electrode portions 3*c* of the heater 3 is connected to power supplying portion 23, 24 via power supplying connectors (not shown) so that, when electric power is supplied from the power supplying portion to the power supply heat generating resistance layer 3*b*, the heater 3 is heated quickly. The power supplying portion includes an AC power source portion 23 and a triac 24. The temperature sensing element 3*e* serves to detect a temperature of the heater 3 and to feed-back temperature information to a control circuit portion (CPU) 22. A temperature detecting device 7 (FIG. 3), such as a thermistor, for detecting a temperature of the surface of the belt 5 is disposed at a downstream side of the nip portion N in the conveying direction of the recording material. Belt temperature detection information obtained from the temperature detecting device 7 is also fed-back to the control circuit portion (CPU) 22.

The control circuit portion (CPU) 22 serves to properly control voltage and frequency supplied from the AC power source portion 23 to the power supply heat generating resistance layer 3*b* via the triac 24, in accordance with temperature detection signal(s) from the temperature detecting device 7 and/or the temperature sensing element 3*e* in such a manner that the temperature adjustment temperature in the nip portion is maintained in a substantially constant value and the heating required for fixing the toner image t onto the recording material P is performed.

In FIG. 3, the thermal insulation stay holder 4 is formed as a trough member having a semi-circular cross-section and serves to hold the heater 3 and to prevent heat radiation toward interior of the belt and also acts as a rotary guide for the belt 5 and is made of liquid crystal polymer, phenol resin, PPS, PEE or the like.

Since the belt 5 is rotated while slidingly contacting with the heater 3 and the thermal insulation stay holder 4 which are disposed inside the belt, it is necessary to minimize friction resistance between the heater 3 and the belt 5 and between the thermal insulation stay holder 4 and the belt. To this end, a small amount of lubricating material such as grease is coated on the heater 3 and the thermal insulation stay holder 4. In this way, the belt 5 can be rotated smoothly.

Figure 7:
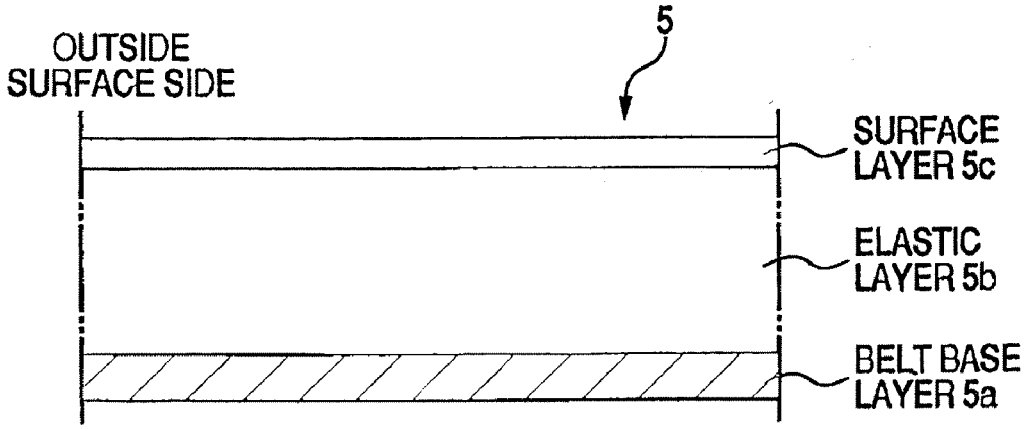
FIG. 7 is a schematic constructional view showing a layer structure of a fixing belt of the fixing apparatus according to the first embodiment.

As shown in FIG. 7 showing a schematic view of a layer structure, the belt 5 is a three-layer structure belt comprising a belt base layer 5*a*, an elastic layer 5*b* and a surface layer 5*c*. The base layer 5*a* constituting an innermost surface is made of resin such as polyimide, polyamide-imide or the like or metal such as nickel or the like. Since the belt must have adequate strength and excellent endurance in order to obtain a heat fixing apparatus having a long service life, an additional strong layer made of polyimide or the like may be provided on the inner surface of the belt. The elastic layer 5*b* for maintaining the fixing ability of the color image is provided on the base layer and is formed from a heat resistive rubber layer made of silicone rubber, fluororubber or the like or a heat resistive resin layer. Further, in order to prevent offset and to maintain the mold releasing ability of the recording material, heat resistive resin(s) having good mold releasing ability such as PFA, PTFE, FEP and/or silicon resin is/are coated solely or in combination, as the surface layer 5*c*. In the illustrated embodiment, the belt 5 having an inner diameter of 30 mm, in which PFA tube having a thickness of 30 μm is used as the surface layer (mold releasing layer) 5*c* and silicone rubber having a thickness of 330 μm is used as the elastic layer 5*b*, and polyimide having a thickness of 50 μm is used, is employed.

Figure 8:
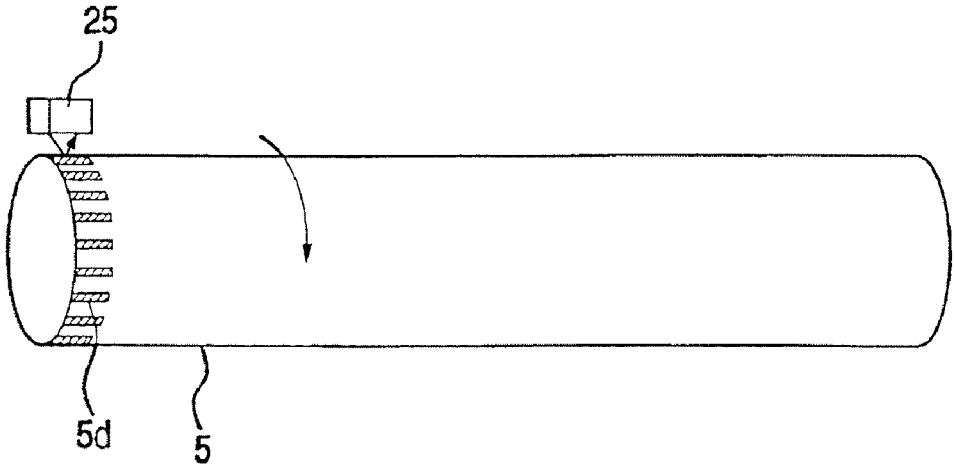
FIG. 8 is an explanatory view a rotational speed control sensor for the fixing belt of the fixing apparatus according to the first embodiment.

Further, as shown in FIG. 8, a marker portion 5*d* in which plural markers each having a width of 1 mm are arranged at an interval of 1 mm is provided on a circumferential surface of one end of the belt 5. The marker portion 5*d* is read by a sensor 25 of optical type for example, and read information is fed-back to the control circuit portion 22. The control circuit portion 22 can detect a rotational shifting amount of the belt 5 on the basis of the feedback signal from the sensor 25 and can control the drive means M to control the shifting of the belt 5 at a predetermined amount and at a predetermined speed.

(3) Belt Correction Sequence

Figure 9:
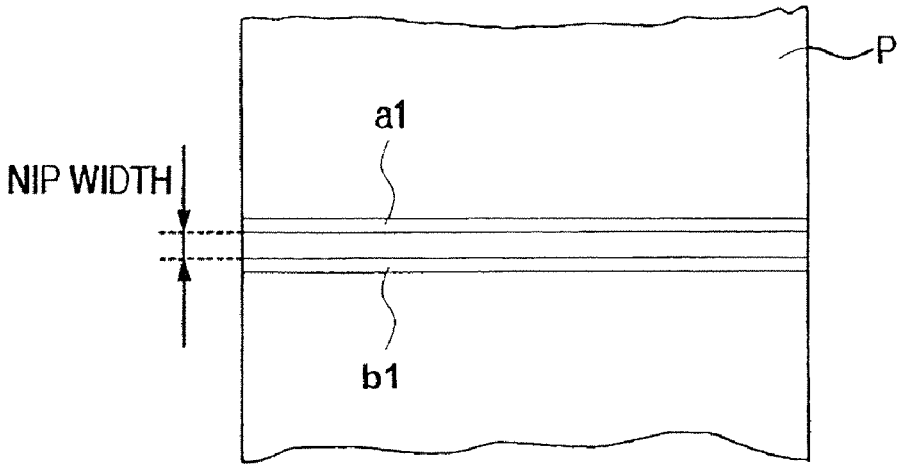
FIG. 9 is an explanatory view showing a bending mark in the vicinity of a nip.

By the way, if the belt 5 of the fixing apparatus 21 is left as it is for a relatively long term, for example, 3 days, in a condition that it is being pressurized in the nip portion and is not driven at all, belt bending marks will be generated in belt portions corresponding to a recording material entrance portion A (FIG. 4) and a recording material exit portion B of the nip portion N (i.e. the belt portions are plastically deformed). As a result, as shown in FIG. 9, streak-like gloss unevenness a1, b1 will be created in the output image in correspondence to the belt bending marks. Incidentally, in a condition that no external force is applied to the belt, the belt according to the illustrated embodiment has a substantially cylindrical shape.

If alumina or silicon nitride is added to the silicone rubber constituting the elastic layer 5*b* of the belt 5 as filler for enhancing thermal conductivity, the rubber itself will behave like resin and a creep property will be worsened. Further, since the polyimide having bad creep property is used in the base layer 5*a*, the whole belt 5 is apt to be deformed plastically.

Figure 10:
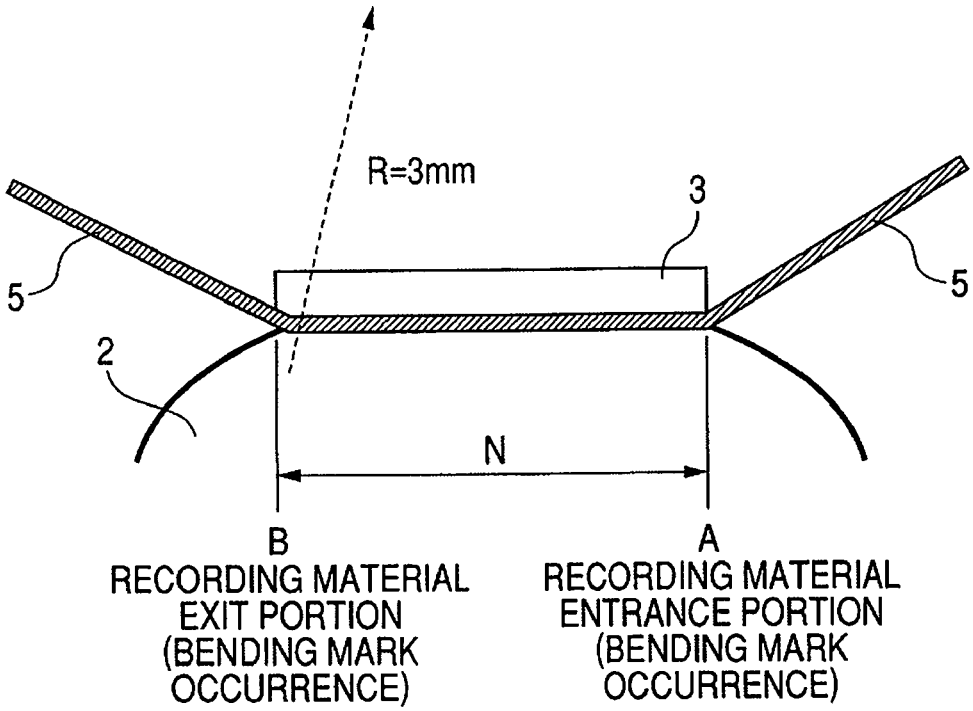
FIG. 10 is a schematic view showing a condition of the belt in the vicinity of the nip of the fixing apparatus according to the first embodiment.

In the illustrated embodiment, the nip portion N is flat in correspondence to the flat heater 3; whereas, since the belt 5 is tension-free, as schematically shown in FIG. 10, the belt rises abruptly at both ends of the nip portion. More specifically, the belt curves or bends with radius of curvature of about 3 mm at in the vicinity of the recording material entrance and exit portions A and B of the nip portion N. Thus, if the fixing apparatus 21 in which the belt includes such bent portions having great radius of curvature is left as it is for a relatively long term in a condition that it is being pressurized in the nip portion and is not driven at all, such bent portions will be kept to generate the belt bending marks more or less.

To cope with this, in the illustrated embodiment, after the fixing apparatus 21 or the image forming apparatus is continuously left as it is for a predetermined time T in the inoperative condition, when the apparatus is used again, by performing the following belt correction sequence, the bending marks of the belt 5 are eliminated quickly, thereby preventing the glossy unevenness and/or streaks due to the belt bending marks from being generated on the image.

The control circuit portion 22 shown in FIG. 4 includes a clock function and time storing function portion (referred to as "timer function portion" hereinafter) 22A. As shown in a flow chart of FIG. 11, when the image forming apparatus is started by apparatus power ON, if the timer function portion 22A detects the fact that the continuous stop time (period) of the apparatus between the finish time of the previous operation of the apparatus and the start time of new operation of the apparatus exceeds the predetermined time T, the control circuit portion 22 carries out the belt correction sequence (stop type) shown in FIG. 12 in the pre-multiple rotation process. If the continuous stop time is shorter than the predetermined time T, the belt correction sequence is not carried out.

Figure 12:
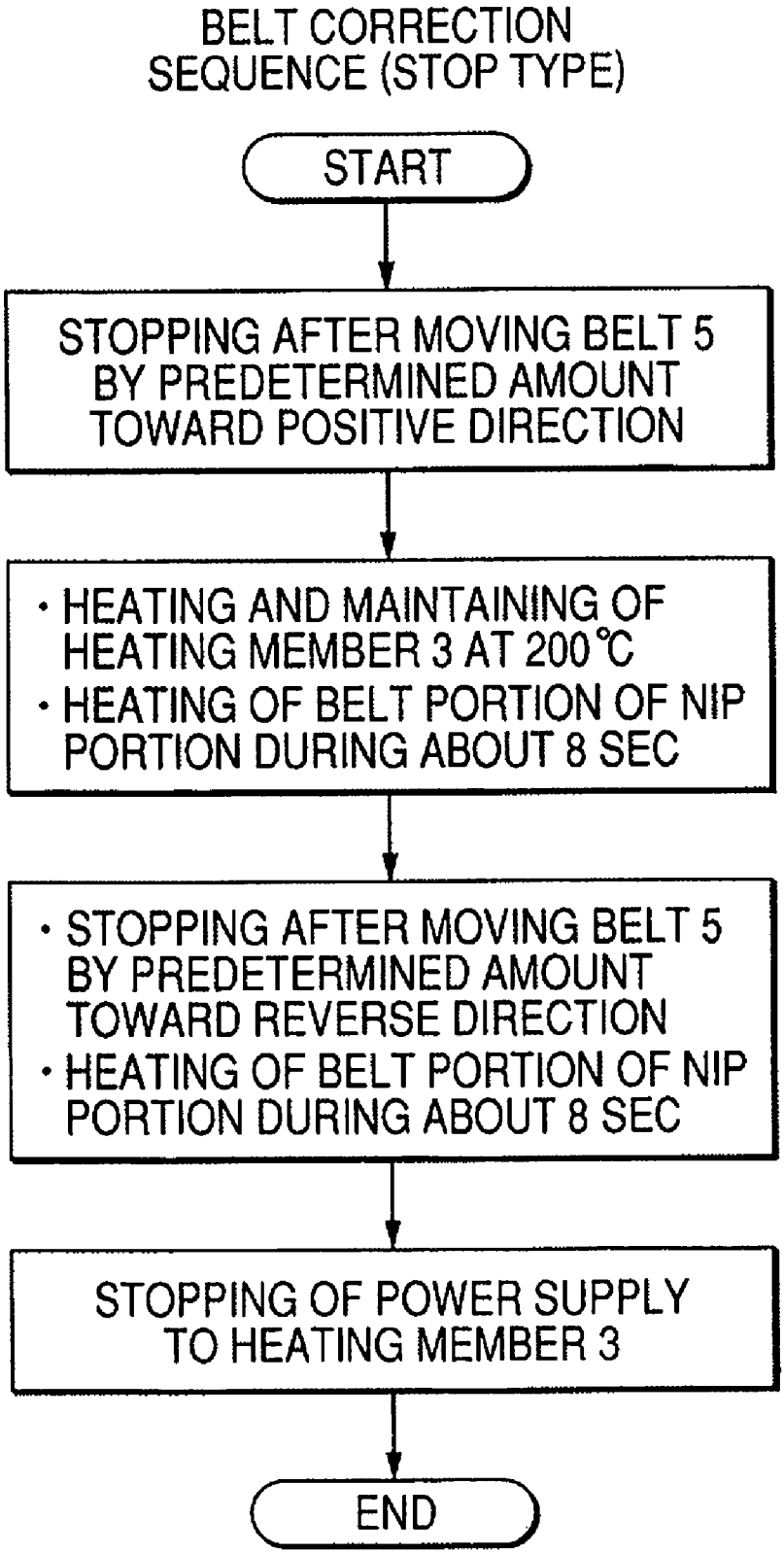
FIG. 12 is a flow chart of the belt correction sequence in the first embodiment.

In the belt correction sequence shown in FIG. 12, when the image forming apparatus is started, the control circuit portion 22 causes the drive means M of the fixing apparatus 21 to drive the pressure roller 2 to be rotated in a normal direction (same as in the image fixing operation) and then to stop the rotation of the pressure roller, with the result that the belt 5 is stopped after the belt is shifted in the normal direction by a predetermined shifting amount. The predetermined shifting amount of the belt 5 corresponds to an amount during which the belt bending mark portion situated at the recording material entrance portion A of the nip portion N is shifted into the nip portion N.

Thereafter, the heater 3 is maintained to about 200° C. by power supply control, and in this condition, the belt bending mark portion of the belt situated in the nip portion N is heated for about 8 seconds. As a result, the bending mark is eliminated by the heating and pressurization in the nip portion N (iron effect).

Then, the control circuit portion 22 causes the drive means M of the fixing apparatus 21 to drive the pressure roller 2 to be rotated in a reverse direction and then to stop the rotation of the pressure roller, with the result that the belt 5 is stopped after the belt is shifted in the reverse direction by a predetermined shifting amount. This predetermined shifting amount of the belt 5 in the reverse direction corresponds to an amount during which the belt bending mark portion situated at the recording material exit portion B of the nip portion N is shifted into the nip portion N. In this condition, the belt bending mark portion of the belt situated in the nip portion N is heated for about 8 seconds. As a result, the bending mark is eliminated by the heating and pressurization in the nip portion N. Then, the power supply to the heating means 3 is stopped, thereby ending the belt correction sequence.

In the illustrated embodiment, as mentioned above, on the basis of the feedback signal from the sensor 25, the control circuit portion 22 can detect the rotational shifting amount of the belt 5 and can control the drive means M to control the predetermined amount shifting of the belt 5. The above-mentioned predetermined amount shifting movements of the belt 5 in the normal and reverse directions are realized by this control.

In this way, by carrying out the belt correction sequence as mentioned above, the belt bending marks generated at the both ends of the nip portion can be eliminated completely in about 15 seconds. Accordingly, the glossy unevenness and the streaks due to the belt bending marks can be prevented from being generated on the image.

For example, if the belt bending marks tries to be eliminated during idle rotation at the conveying speed of 100 mm/sec in the image fixing, since the heating and pressurizing time in the nip portion is short, it takes about 30 minutes to eliminate the belt bending marks.

In conclusion, by using the illustrated embodiment, the bending marks can be eliminated quickly.

Figure 11:
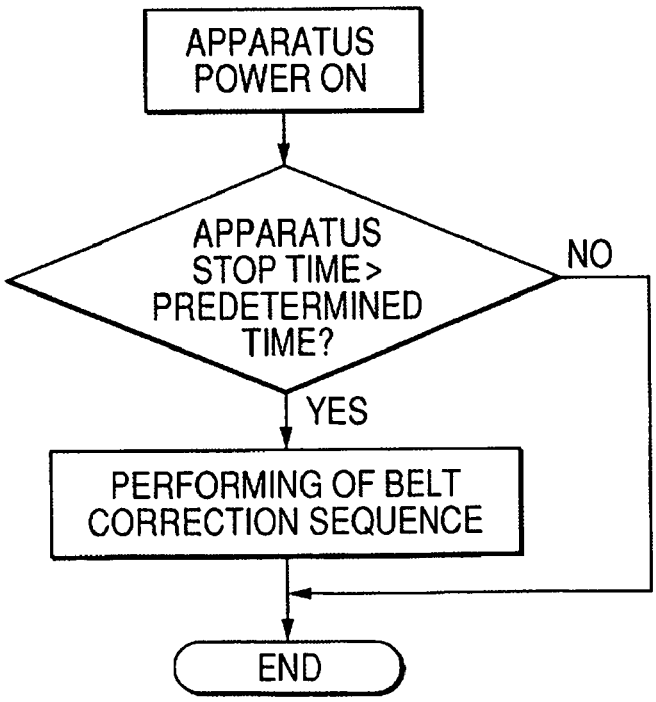
FIG. 11 is a flow chart for selection of a belt correction sequence in the first embodiment.

In FIG. 11, the predetermined time T can be appropriately selected to any time on the basis of conditions of the actual bending marks of the belt 5.

In the belt correction sequence shown in FIG. 12, the shifting movement of the belt in the reverse direction may be performed firstly and then the shifting movement in the normal direction may be performed.

Further, according to the illustrated embodiment, in FIG. 2, in a case where, after the pre-multiple rotation process of the image forming apparatus is finished and the stand-by condition is established temporarily, the pre-rotation process is carried out on the basis of the image forming start signal, if the stand-by time exceeds the predetermined time T, the belt correction sequence is performed also in this pre-rotation process.

In this way, by adopting the arrangement in which, when the rotation of the belt is started, the belt portions which have been positioned in the vicinity of the ends of the nip portion during the stoppage of the belt can be shifted into the nip portion and then such belt portions can be heated, the bending marks generated during the inoperative condition of the apparatus can be eliminated quickly by the iron effect, and thus, the glossy unevenness and streaks due to the belt bending marks can be prevented from being generated on the image.

Second Embodiment

Figure 13:
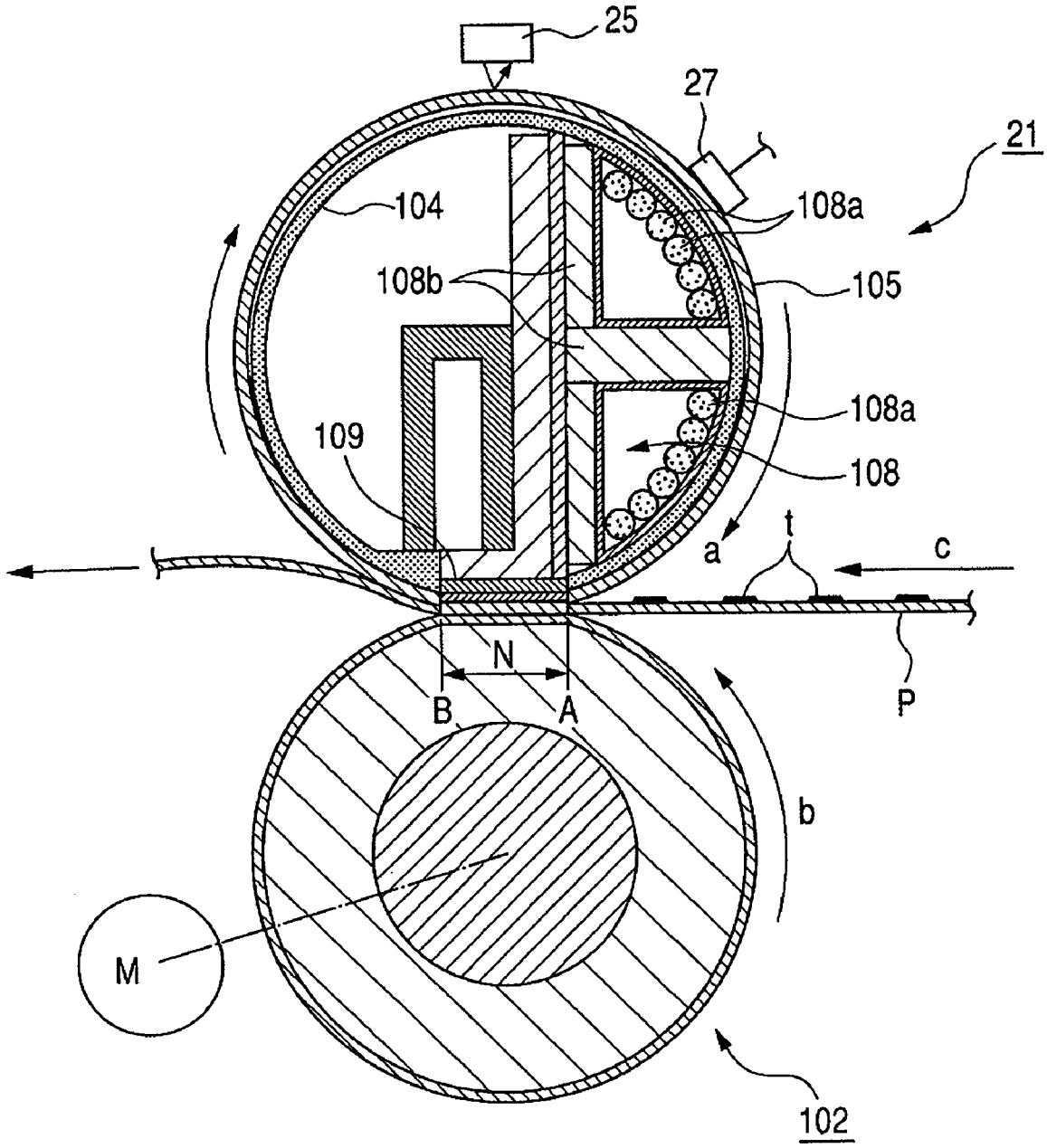
FIG. 13 is a schematic constructional view of a fixing apparatus according to a second embodiment of the present invention.

FIG. 13 is a schematic sectional view of a fixing apparatus 21 of electromagnetic induction heating type according to a second embodiment of the present invention.

(1) Whole Construction of Fixing Apparatus 21

A fixing belt (laminated belt-shaped heating rotary member; referred to as "belt" hereinafter) 105 is a flexible cylindrical endless belt. The belt 105 has an electromagnetic induction heat generating ability. A layer-structure of the belt will be described later.

The belt 105 is loosely mounted around a cylindrical thermal insulation stay holder (belt guiding member) 104.

Magnetic field generating means (heating means for heating the belt) 108 disposed within the thermal insulation stay holder 104 comprises an exciting coil 108*a* and a T-shaped magnetic core (core member) 108*b*.

An elastic pressure roller 102 is urged against a lower surface of the thermal insulation stay holder 104 with the interposition of the belt 105 with predetermined pressure to form a fixing nip portion (referred to merely as "nip portion" hereinafter) N having a predetermined width therebetween.

The pressure roller 102 is rotatingly driven by drive means M in an anti-clockwise direction shown by the arrow b. By the rotation of the pressure roller 102, a friction force between the pressure roller 102 and the outer surface of the belt 105 at the nip portion N applies a rotational force to the belt 105, with the result that the belt is rotated around the thermal insulation stay holder 104 in a clockwise direction shown by the arrow a at a peripheral speed substantially equal to the peripheral speed of the pressure roller 102 in such a manner that an inner surface of the belt is contacted with and slid on the lower surface of the heating means thermal insulation holder 104 at the nip portion N.

Incidentally, at the nip portion N, a sliding plat 109 fixedly fitted to the thermal insulation stay holder 104 serves to reduce a friction force between the sliding plate and the inner surface of the belt 105. Here, since the sliding plat 109 is formed from a flat plate, the fixing nip portion has a flat configuration. More specifically, the sliding plat 109 is constituted by coating glass on a ceramic plate.

The thermal insulation stay holder 104 serves to apply pressure to the nip portion N, to support an exciting coil 108*a* and an magnetic core 108*b* which constitute magnetic field generating means 108, to support the belt 105 and to maintain conveying stability during the rotation of the belt 105. The thermal insulation stay holder 104 is formed from insulation material which does not prevent passage of magnetic flux and is made of material capable of enduring high load.

Figure 14:
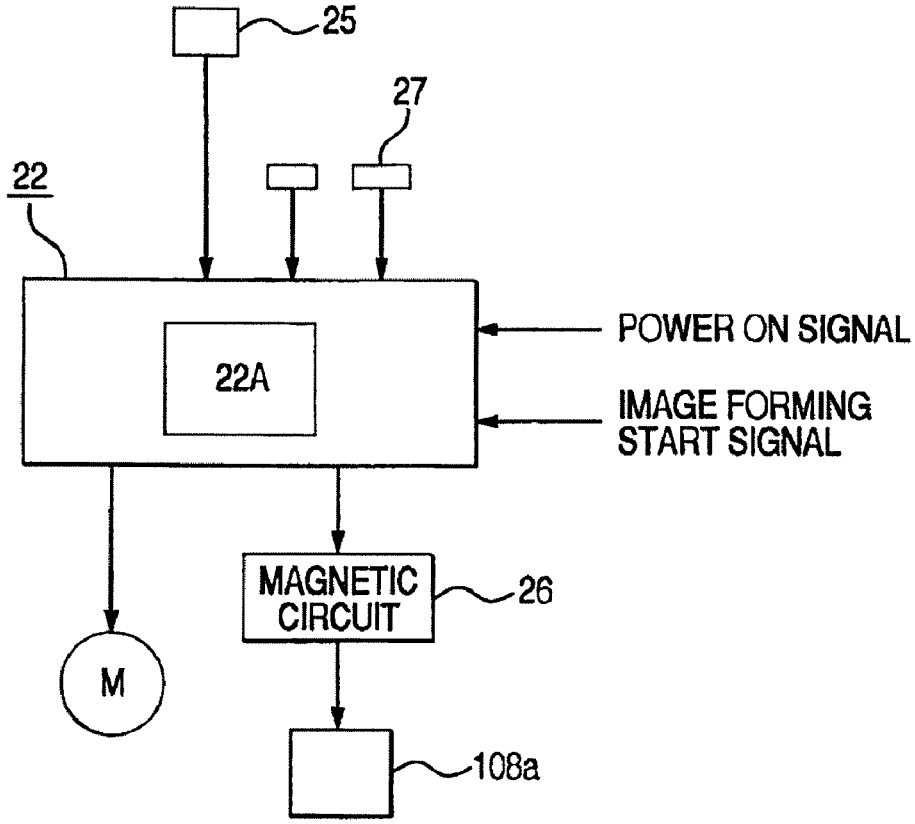
FIG. 14 is a block diagram of a control system of the fixing apparatus according to the second embodiment.

FIG. 14 is a block diagram of a control system of the fixing apparatus. The exciting coil 108*a* of the magnetic field generating means 108 generates alternating magnetic flux on the basis of alternating current supplied from an exciting circuit 26. The alternating magnetic flux is introduced into an electromagnetic induction heating layer of the belt 105 by the magnetic core 108*b* to generate eddy current in the electromagnetic induction heating layer. The eddy current generates Joule heat by specific resistance of the electromagnetic induction heating layer. The temperature of the belt 105 is detected by a temperature sensing element 27 and temperature information is fed-back to a control circuit portion (CPU) 22. On the basis of the temperature detection signal from the temperature sensing element 27, the control circuit portion 22 controls supply of electrical current from the exciting circuit 26 to the exciting coil 108*a*, thereby performing temperature adjustment to maintain the temperature of the belt to a predetermined temperature.

When the pressure roller 102 is rotatingly driven, the cylindrical belt 105 is rotated around the thermal insulation stay holder 104, and, by power supply from the exciting circuit 26 to the exciting coil 108*a*, as mentioned above, the belt 105 is heated due to electromagnetic induction, thereby increasing the temperature of the nip portion N to the predetermined temperature. Under the temperature adjustment condition, a recording material P on which a non-fixed toner image t conveyed from an image forming means (not shown) was formed is introduced between belt 105 and the pressure roller 102 at the nip portion N and is conveyed together with the belt 105 through the nip portion N while closely contacting with the outer surface of the belt 105. While the recording material P is being conveyed together with the belt 105 through the nip portion N, the recording material is heated by the electromagnetic induction heat of the belt 105, with the result that the non-fixed toner image t is thermally fixed onto the recording material P. After leaving the nip portion N, the recording material P is separated from the outer surface of the rotating belt and is conveyed for discharging. In this case, since the curvatures of the fixing belt at the recording material entrance and exit portions of the nip portion N are great, the recording material P can easily be separated from the fixing belt.

Figure 15:
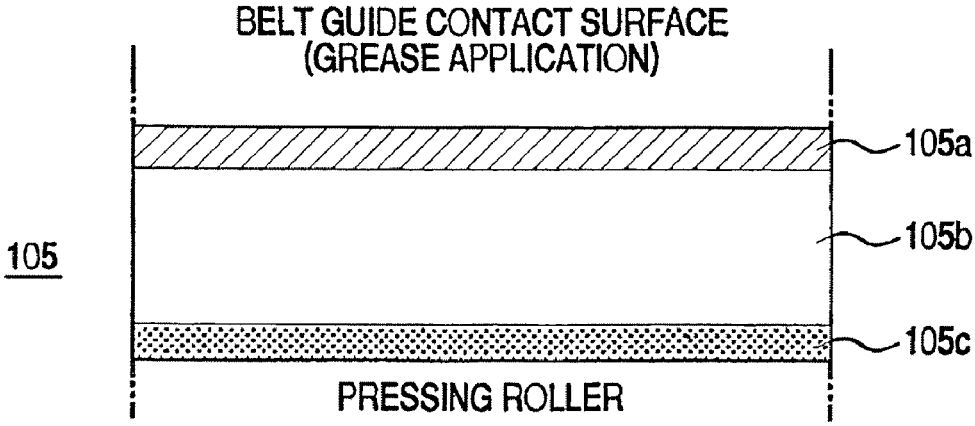
FIG. 15 is a schematic view showing a layer structure of a fixing belt of the fixing apparatus according to the second embodiment.

FIG. 15 is a schematic view showing a layer structure of the belt 105 according to the illustrated embodiment. The belt 105 has a composite structure comprising a base layer 105*a* acting as a heating layer of the electromagnetic induction heating belt 105 and formed from a metal belt, an elastic layer 105*b* formed from a resin layer or a rubber layer laminated on the outer surface of the base layer, and a surface layer (mold releasing layer) 105*c* laminated on the outer surface of the elastic layer. To achieve adhesion between the base layer 105*a* and the elastic layer 105*b* and adhesion between the elastic layer 105*b* and the surface layer 105*c*, primer layers (not shown) mat be provided between these layers.

In the belt 105 of a substantially cylindrical shape having an inner diameter of 34 mm, the base layer 105*a* is positioned at an inner surface side and the surface layer 105*c* is positioned at an outer surface side. When alternating magnetic flux is applied to the base layer 105*a*, eddy current is generated in the base layer 105*a* to heat the latter. The heat of the base layer is applied to the belt 105 via the elastic layer 105*b* and the surface layer 105*c*, with the result that the recording material P being passed through the nip portion N is heated, thereby thermally fixing the toner image t.

The elastic layer 105*b* is made of heat resistive material having good heat conductivity such as silicone rubber, fluororubber, fluorosilicone rubber or the like and, preferably, has a thickness of 10 to 500 μm. The elastic layer 105*b* is necessary for ensuring fixed image quality.

In a case where a color image is printed, particularly regarding an electrophotographic image, a solid image is formed on the recording material P over a wide area. In this case, if the heating surface (mold releasing layer) cannot follow unevenness on the recording material or unevenness on the toner layer, heating unevenness will be generated, with the result that glossy unevenness is generated between a region to which much heat is transferred and a region to which less heat is transferred. The region to which much heat is transferred has high gloss and the region to which less heat is transferred has low gloss. Regarding the thickness of the elastic layer 105*b*, if the thickness is smaller than 10 μm, the belt cannot follow the unevenness on the recording material or on the toner layer completely, with the result that the glossy unevenness is generated in the image. On the other hand, if the thickness of the elastic layer 105*b* is greater than 1000 μm, the heat resistance of the elastic layer becomes great, and thus, it is difficult to realize quick start. More preferably, the thickness of the elastic layer 105*b* is 50 to 500 μm. Regarding hardness of the elastic layer 105*b*, if the hardness is too great, the belt cannot follow the unevenness on the recording material or on the toner layer completely, with the result that the glossy unevenness is generated in the image. Thus, the hardness of the elastic layer is Preferably smaller than 60° (JIS-A) and more preferably smaller than 45° (JIS-A). In the illustrated embodiment, silicone rubber having hardness of 20° is used as the elastic layer.

As material for the surface layer 105*c*, material having good mold releasing ability and good heat resistance such as fluororesin, silicon resin, fluorosilicone rubber, fluororubber, silicone rubber, PFA, PTFE, FEP or the like can be selected. A thickness of the surface layer 105*c* is preferably 1 to 100 μm. If the thickness of the surface layer 105*c* is smaller than 1 μm, there arises a problem that, due to coating unevenness on the coating film, an area having poor mold releasing ability is generated and/or endurance becomes insufficient. On the other hand, if the thickness of the surface layer 105*c* exceeds 100 μm, heat conductivity will be worsened, and, particularly in case of a resin mold releasing layer, hardness becomes too great, thereby nullifying the effect of the elastic layer. In the illustrated embodiment, a PFA tube having a thickness of 50 μm is used as the surface layer 105*c*.

The base layer 105*a* may be made of ferromagnetic metal such as nickel, iron, ferromagnetic SUS or nickel/cobalt alloy. Although nonmagnetic metal can also be used, more preferably, metal capable of absorbing magnetic flux, such as nickel, iron, magnetic stainless or cobalt/nickel alloy is used. In the illustrated embodiment, from the viewpoint that a metal layer having good thickness accuracy and also having good configuration accuracy can be produced by providing unevenness on a mold surface in the manufacture, nickel is electroformed to obtain a metal layer for the base layer.

The thickness thereof is preferably greater than a surface skin depth represented by the following equation and smaller than 200 μm. The surface skin depth σ[m] is represented as follows:

$$\sigma=503\times(\rho/f\mu)^{1/2}$$

where, f[Hz] is frequency of the exciting circuit, μ is permeability and ρ[Ωm] is specific resistance. This indicates absorption depth for an electromagnetic wave used in electromagnetic induction, and from this, intensity of the electromagnetic wave is smaller than 1/e in the deepest position; speaking reversely, almost all energy is absorbed up to this depth position. A thickness of the heating layer is preferably 1 to 100 μm. If the thickness of the heating layer is smaller than 1 μm, since almost all energy cannot be absorbed, efficiency is worsened. On the other hand, if the thickness of the heating layer exceeds 100 μm, rigidity becomes too great and flexibility is worsened, the use of this belt as the rotary member is not practical. Accordingly, the thickness of the base layer 105*a* as the heating layer is preferably 1 to 100 μm. In the illustrated embodiment, a nickel layer having a thickness of 50 μm is used as the base layer.

In the illustrated embodiment, as mentioned above, the nickel base layer 105*a* is produced by electroforming. The electroforming is a kind of plating, in which electrolyte is provided around a master mold and electric current is applied to the electrolyte to cause electrophoresis of metal ions thereby to grow metal crystals around the master mold, thereby forming a belt-shaped metal cylinder. In this case, when the surface of the master mold is roughened, since the same configuration as that of the surface of the master mold is transferred onto the surface of the produced electroformed belt, the roughness can be obtained with very high accuracy.

In the illustrated embodiment, since it is desired that the inner surface of the belt is roughened, nickel is grown on a surface of an inner mold obtained by sand blasting a rod-shaped aluminum.

(2) Belt Correction Sequence

Also in the fixing apparatus 21 as mentioned above, since the curvatures of the belt 105 are great at both ends of the nip portion N in the width-wise direction (belt shifting direction), i.e. at the recording material entrance portion A and the recording material exit portion B of the nip portion and since silicone rubber having high heat conductivity is used as the elastic layer 105*b* of the belt 105, if the belt 105 is left as it is for a relatively long term in the condition that the belt is pressurized in the nip portion and is not driven, bending marks are generated in belt portions corresponding to the recording material entrance portion A and the recording material exit portion B of the nip portion N.

Thus, in the illustrated embodiment, after the fixing apparatus 21 or the image forming apparatus is continuously left as it is for a predetermined time T in the inoperative condition, when the apparatus is used again, by performing the following belt correction sequence, the belt bending marks are eliminated quickly, thereby preventing the glossy unevenness and/or streaks due to the belt bending marks from being generated on the image. Incidentally, other than the arrangement in which the belt bending marks are eliminated completely as a result of execution of the belt correction sequence, an arrangement in which correction is made at least toward a direction for eliminating the belt bending marks may also be adopted.

Figure 16:
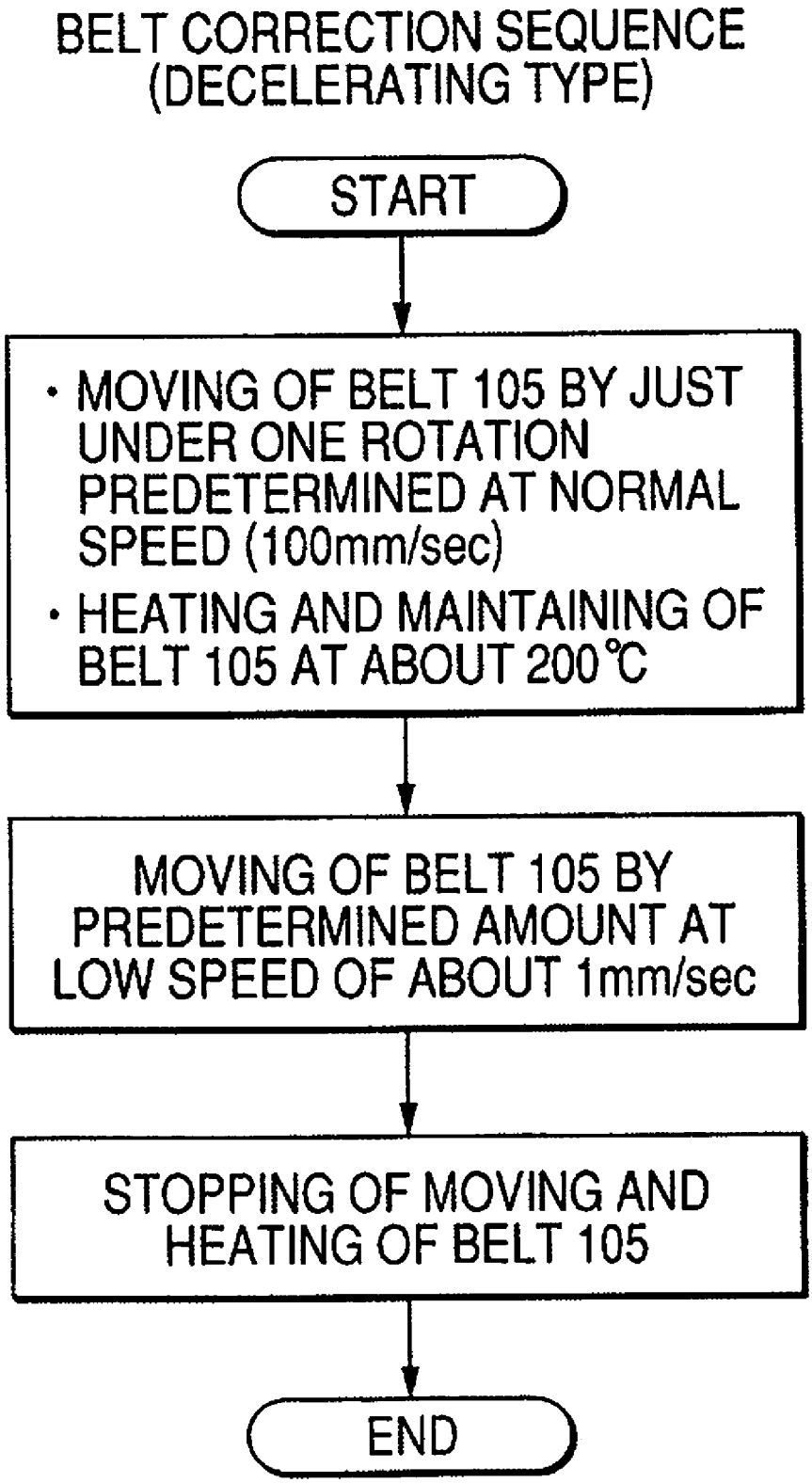
FIG. 16 is a flow chart of a belt correction sequence in the second embodiment.

Similar to the first embodiment, when the image forming apparatus is started by apparatus power ON, if the timer function portion 22A detects the fact that the continuous stop time of the apparatus between the finish time of the previous operation of the apparatus and the start time of new operation of the apparatus exceeds the predetermined time T, the control circuit portion 22 carries out the belt correction sequence shown in FIG. 16 in the pre-multiple rotation process. If the continuous stop time is shorter than the predetermined time T, the belt correction sequence is not carried out.

In the belt correction sequence shown in FIG. 16, when the image forming apparatus is started, the control circuit portion 22 causes the drive means M of the fixing apparatus 21 to drive the pressure roller 102 to be rotated in a normal direction thereby to shift the belt 105 in the normal direction at a normal speed (100 mm/sec) by a predetermined little less than one revolution. Further, alternating current from the exciting circuit 26 is supplied to the exciting coil 108*a* to heat the belt 105 by electromagnetic induction, thereby maintaining the temperature of the belt 105 to about 200° C.

In this case, the shifting amount of the belt 105 by the predetermined little less than one revolution corresponds to an amount during which the belt portion situated at the recording material exit portion B of the nip portion N entered into the recording material entrance portion A of the nip portion N.

Thereafter, the control circuit portion 22 reduces the speed of the drive means M to shift the belt 105 at a low speed of about 1 mm/sec by a predetermined amount.

The low speed shifting amount of the belt 105 by the predetermined amount-corresponds to a belt shifting amount during which the belt portion corresponding to the recording material exit portion B and entered into the recording material entrance portion A of the nip portion N passes through the nip portion and further the belt portion corresponding to the recording material entrance portion A of the nip portion N also enters into the nip portion and passes through the nip portion.

In this way, the above-mentioned two bending marks on the belt portions shifted at the low speed in the nip portion N are successively eliminated by the heating and the pressurizing in the nip portion N (iron effect).

Then, the shifting and the heating of the belt 105 are stopped, and the belt correction sequence is ended.

Also in this embodiment, similar to the first embodiment, the control circuit portion 22 can detect the rotational shifting amount of the belt 105 on the basis of the feedback signal from the sensor 25 and can control the drive means M to shift the belt 105 at the predetermined speed by the predetermined amount. The predetermined amount and predetermined speed shifting movement of the belt 105 in the belt correction sequence is performed by this control.

In the illustrated embodiment, a width of the nip portion N is about 7 mm, and, after the belt bending mark portions are entered into the nip portion N, all portions pass through the nip portion in about 14 seconds. By such operations, the belt bending marks are eliminated faster than the case where the belt 105 is conveyed at the normal speed.

Further, also according to the illustrated embodiment, in FIG. 2, in a case where, after the pre-multiple rotation process of the image forming apparatus is finished and the stand-by condition is established temporarily, the pre-rotation process is carried out on the basis of the image forming start signal, if the stand-by time exceeds the predetermined time T, the belt correction sequence is performed also in this pre-rotation process.

In this way, by adopting the arrangement in which, when the rotation of the belt is started, the belt portions which have been positioned in the vicinity of the ends of the nip portion during the stoppage of the belt can be shifted into the nip portion and then such belt portions can be heated, the bending marks generated during the inoperative condition of the apparatus can be eliminated quickly by the iron effect, and thus, the glossy unevenness and streaks due to the belt bending marks can be prevented from being generated on the image.

Third Embodiment

Figure 17:
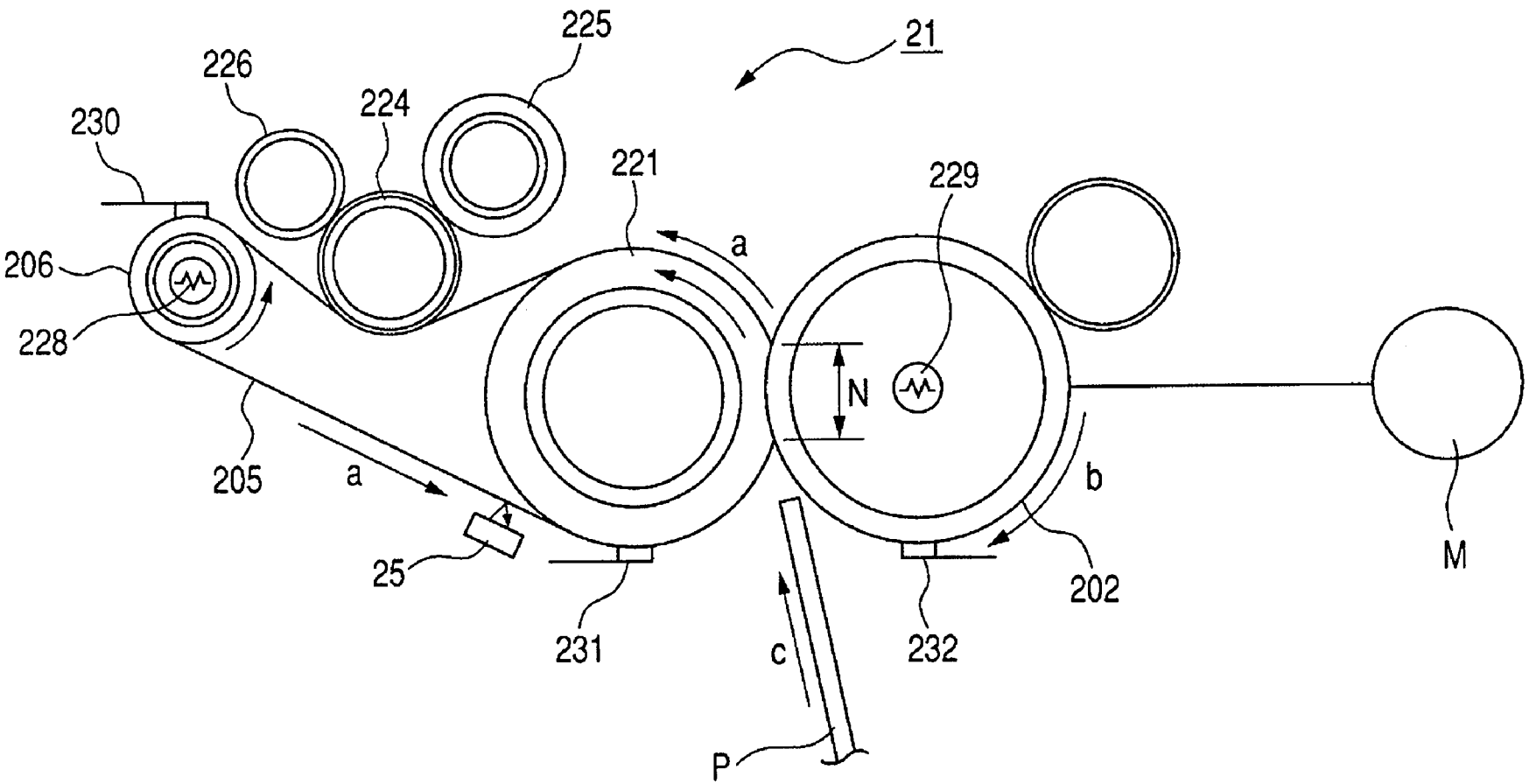
FIG. 17 is a schematic constructional view of a fixing apparatus according to a third embodiment of the present invention.

FIG. 17 is a schematic sectional view of a fixing apparatus 21 according to a third embodiment of the present invention.

(1) Whole Construction of Fixing Apparatus 21

Within the fixing apparatus 21, a fixing roller 221 and a heating roller 206 are disposed in parallel with each other and are separated from each other. A flexible endless fixing belt (laminated belt-shaped heating rotary member; referred to as "belt" hereinafter) 205 as an endless belt is wound around the fixing roller 221 and the heating roller 226 in a looped fashion.

The fixing roller 221 is constituted, for example, by coating a metal core with a soft material such as silicone rubber. In order to increase a contact area between the belt 205 and a pressure roller 202 which will be described later, it is preferable that a heat resistive material having low hardness such as silicone sponge is provided on an outer peripheral surface of the fixing roller 221.

The heating roller 226 is constituted, for example, by coating fluororesin on a metal core. In order to supply heat to the belt 205 efficiently, the heating roller 226 is preferably formed from a material having high heat conductivity and is made of aluminum or copper, for example.

A base material for the belt 205 is preferably of the thin (several tens μm) seamless type which is formed from metal such as stainless steel or nickel or heat resistive resin such as polyimide. A heat resistive layer or a heat resistive rubber layer made of silicone rubber or the like is laminated on a surface of the base material of the belt 205 and a heat resistive mold releasing layer made of fluororesin or the like is laminated on the heat resistive layer. In the illustrated embodiment, a heat conductive filler added silicone rubber layer having a thickness of 500 μm and a fluororesin layer having a thickness of 30 μm are used.

The pressure roller (driving roller) 202 is disposed to abut against the fixing roller 221. The pressure roller 202 serves to urge the belt 205 against the fixing roller 221. A recording material P carrying a non-fixed toner image is introduced into a fixing nip portion (referred to merely as "nip portion" hereinafter) in which the belt 205 is pinched between the fixing roller 221 and the pressure roller 202.

The pressure roller 202 is preferably coated by a thin material having great coefficient of friction such as silicone rubber in order to rotate the belt 205 and the fixing roller 221 at a constant speed even if temperatures of the belt 205 and the fixing roller 221 are changed.

Incidentally, although it is desired that an outer peripheral surface of the pressure roller 202 is coated by a material having excellent toner mold releasing ability, since such material having excellent mold releasing ability also has low coefficient of friction, it is apprehended that poor conveying of the recording material P is caused by the fact that, when the recording material P is inserted between the pressure roller 202 and the belt 205, the pressure roller 202 is slid with respect to the belt 205. In order to prevent the poor conveying of the recording material P, in the pressure roller 202, fixing roller 221 and belt 205, it is desired that lengths of respective non-sheet pass areas (areas not pinching the recording material P) are increased or end portions of the pressure roller 202 are coated by a material having low toner mold releasing ability i.e. a material having high coefficient of friction to transfer an adequate driving force to the fixing roller 221.

In order to apply peeling oil to the belt 205, a donor roller (oil coating roller) 224 and an oil supplying roller 225 are disposed above the belt 205. An outer peripheral surface of the donor roller 224 is coated by silicone rubber. The donor roller 224 is contacted with a portion of the belt 205 running from the fixing roller 221 toward the heating roller 206 while rotating at a peripheral speed equal to a running speed of the belt portion. By urging the oil supplying roller 225 against the outer peripheral surface of the donor roller 224 with a moderate urging force, the peeling oil is stably coated on the outer peripheral surface of the belt 205 from the oil supplying roller 225 via the donor roller 224.

A surface layer of the donor roller 224 is set to have the mold releasing ability worse than that of a surface layer of the belt 205. Thus, residual toner not fixed to the recording material P and remaining on the belt 205 is transferred onto the donor roller 224. In order to remove the toner transferred to the donor roller 224, a cleaning roller 226 is provided to be urged against the outer peripheral surface of the donor roller 224 with a moderate urging force. An outer peripheral surface of the cleaning roller 226 is coated by a material having a surface rougher than the donor roller 224, for example, such as felt or non-woven fabric.

The heating roller 206 incorporates therein a halogen heater lamp 228 as a heat source. Incidentally, as the heat source, in place of the halogen heater lamp 228, a carbon heater, a heat generating resistance member, an electromagnet induction heating device or the like may be used. The pressure roller 202 incorporates therein a halogen heater lamp 229 as a heat source in order to achieve stable fixing even if a feeding speed of the recording material P is high. Incidentally, similar to the heating roller 206, as the heat source, in place of the halogen heater lamp 229, a heat generating resistance member, an electromagnet induction heating device or the like may be used.

A first temperature detecting device 230 for detecting a temperature of the heating roller 226 during the fixing belt 205 is stopped is disposed in the vicinity of the heating roller 206. A second temperature detecting device 231 for detecting the temperature of the fixing belt 205 near the nip portion N is disposed in the vicinity of the fixing roller 221. Further, in the vicinity of the pressure roller 202, there is disposed a third temperature detecting device 232 for detecting a temperature of the outer peripheral surface of the pressure roller 202, whether the fixing belt 205 is running or is stopped.

The pressure roller 202 is connected to an output shaft of the drive motor M so that, when the drive motor M is operated, the pressure roller 202 is rotated in a clockwise direction shown by the arrow b. As shown by the arrow c, when the recording material P is inserted into the nip portion N, the belt 205 is urged against the surface of the recording material P positively by a pinching force generated between the pressure roller 202 and the fixing roller 221. In synchronous with the rotation of the pressure roller 202, the belt 205 is running in an anti-clockwise direction shown by the arrow a by a friction force, and the fixing roller 221 is also rotated in the same direction by a friction force between the fixing roller 221 and the belt 205. Further, the heating roller 226 is also rotated in the same direction by a friction force between the heating roller and the belt 205.

While the belt 205 is running, together with the recording material P, through the nip portion N between the fixing roller 221 and the pressure roller 202, the toner image on the belt 205 is thermally fused and is fixed onto the recording material P.

Figure 18:
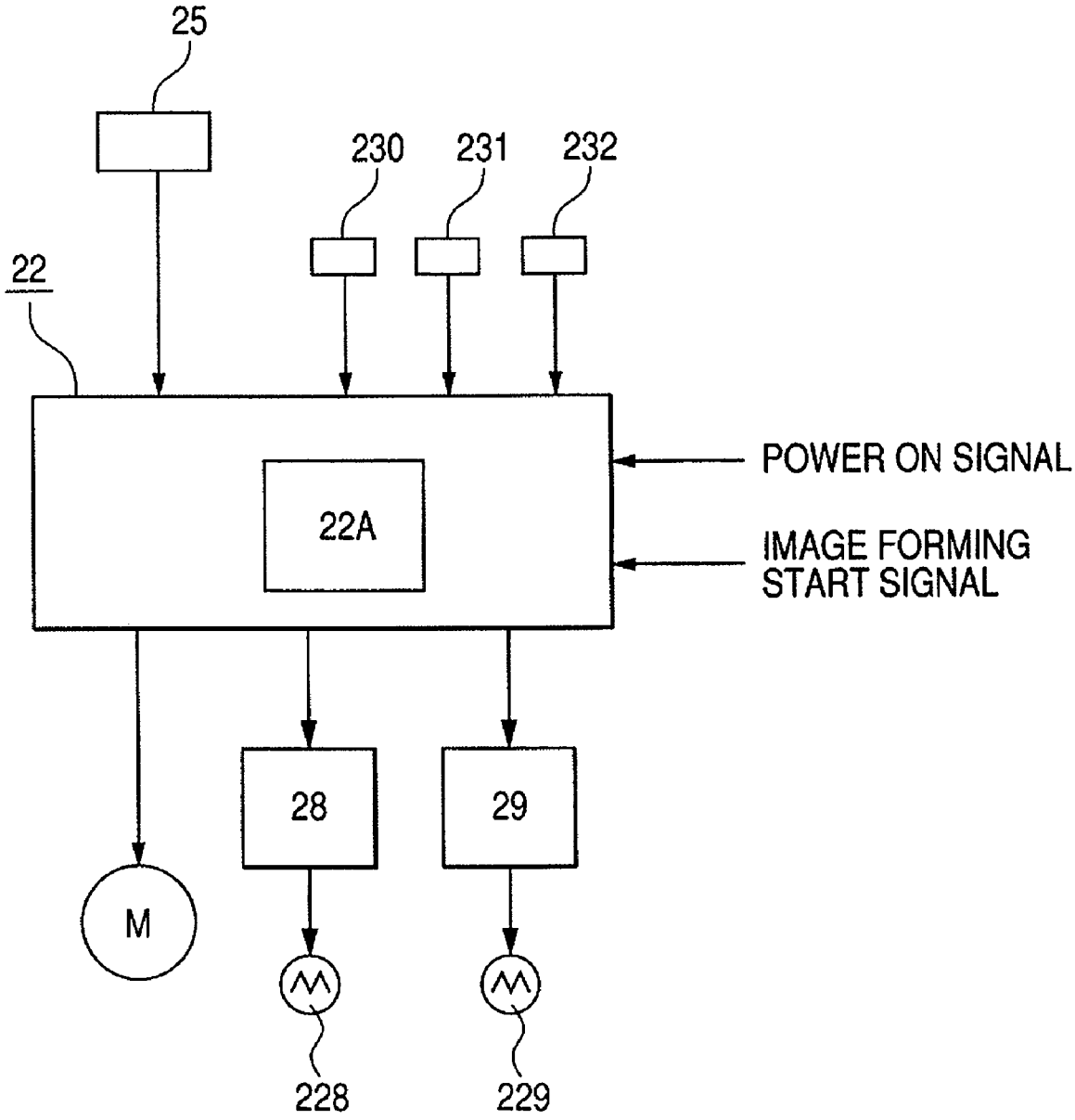
FIG. 18 is a block diagram of a control system of the fixing apparatus according to the third embodiment.

FIG. 18 is a block diagram of a control system of the fixing apparatus. In response to temperature detection signals inputted from the first to third temperature detecting devices 230, 231 and 232, a control circuit portion (CPU) 22 controls power supply circuit portions 28 and 29 to adjust electric powers to be supplied to the halogen heater lamps 228 and 229, thereby performing temperature adjustment of the temperatures of the heating roller 206, belt 205 and pressure roller 202 to predetermined temperatures. Further, the control circuit portion 22 can detect a rotational shifting amount of the belt 205 on the basis of the feedback signal from the sensor 25 for the belt 205 and can control the drive means M for the belt 205 to shift the belt 205 at a predetermined speed by a predetermined amount.

(2) Belt Correction Sequence

In the fixing apparatus 21 as mentioned above, in order to make the apparatus compact, the donor roller 224 and the heating roller 221 having a small diameter (16 mm), respectively, are used. The donor roller 224 is urged against the belt 205 so that the belt portion is partially wound around the donor roller, and the belt 205 can be tensioned via the heating roller by biasing means (not shown). Thus, if the apparatus is left as it is more than the predetermined time, a winding curl is generated on a front surface of the belt 205 by the donor roller 224 and a winding curl is generated on a back surface of the belt by the heating roller 206. Since the winding curl generated by the donor roller has a concave shape with respect to the nip portion and is bent at both ends of the winding area of the donor roller 224, this winding curl may cause streaks on the fixed image. Further, the winding curl generated by the heating roller 226 has a convex shape with respect to the nip portion N and is contacted with the non-fixed toner image on the recording material P immediately before the nip portion. Thus, image troubles such as offset marks and image scattering may cause in the fixed image.

In a case where the belt tension is set to 78.4 N, streak occurrence states based on the diameters of the donor roller 224 are shown in the following Table 1, and scattering occurrence states based on the diameters of the heating roller 226 are shown in the following Table 2. In these rollers 224 and 206, when the diameter exceeds 16 mm, the winding curls are almost not generated, but, when the diameter is smaller than 16 mm particularly smaller than 10 mm, the image quality due to the winding curls is worsened considerably.

TABLE 1

| Donor roller diameter [mm] | Streak occurrence state |
|---|---|
| 16 | ○ |
| 14 | Δ |
| 12 | Δ |
| 10 | X |

TABLE 2

| Heating roller diameter [mm] | Scattering occurrence state |
|---|---|
| 16 | ○ |
| 14 | Δ |
| 12 | X |
| 10 | X |

○: Good
Δ: No Problem in Practice
X: Not Good

To cope with this, in the illustrated embodiment, after the fixing apparatus 21 or the image forming apparatus is continuously left as it is for a predetermined time T in the inoperative condition, when the apparatus is used again, by performing the following belt correction sequence, the winding curl of the belt 205 generated by the heating roller 226 and the winding curl generated by the donor roller 224 are eliminated quickly, thereby preventing occurrence of poor image.

Figure 19:
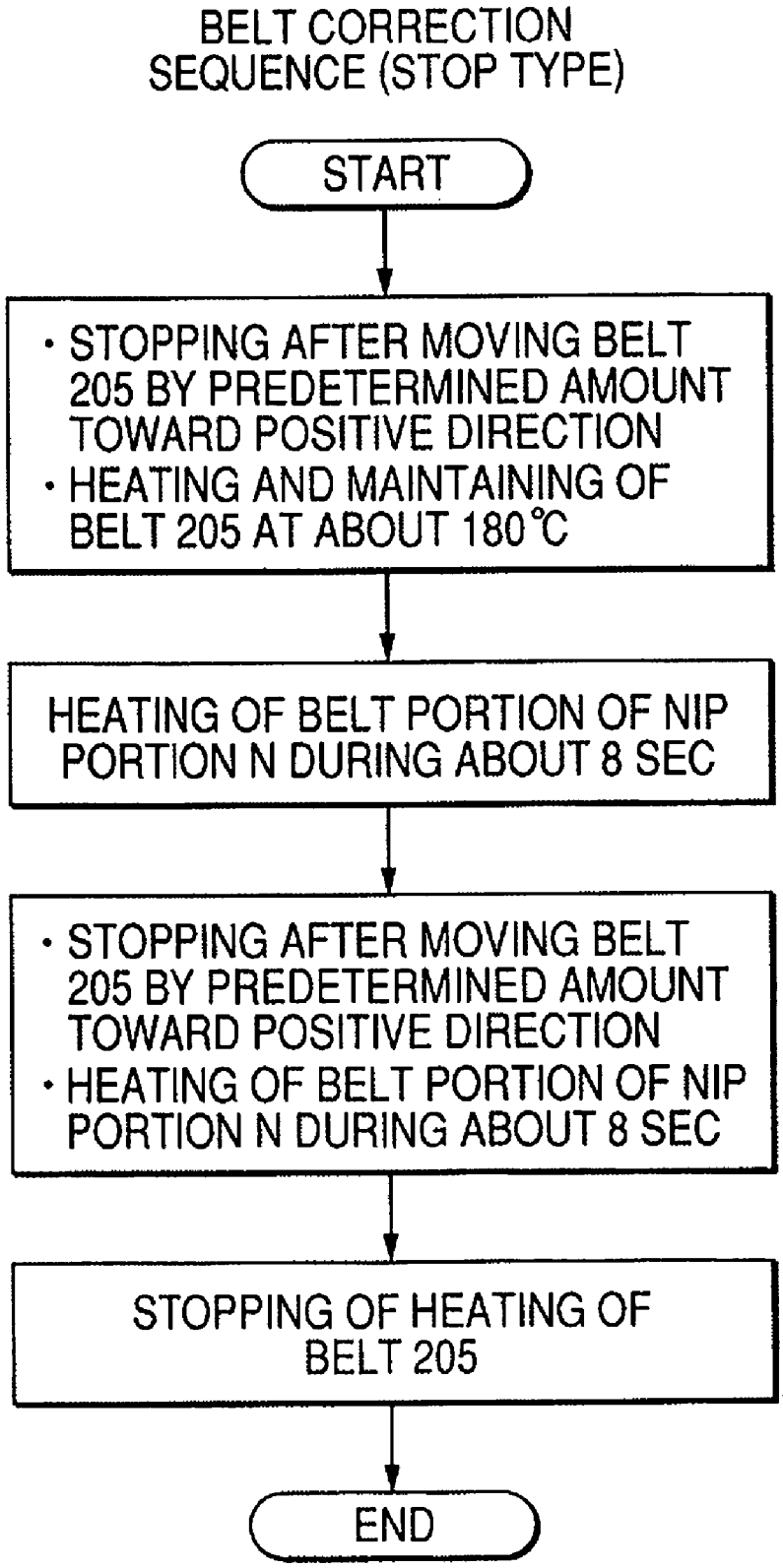
FIG. 19 is a flow chart of a belt correction sequence in the third embodiment.

Similar to the first embodiment, when the image forming apparatus is started by apparatus power ON, if the timer function portion 22A detects the fact that the continuous stop time of the apparatus between the finish time of the previous operation of the apparatus and the start time of new operation of the apparatus exceeds the predetermined time T, the control circuit portion 22 carries out the belt correction sequence (stop type) shown in FIG. 19 in the pre-multiple rotation process. If the continuous stop time is shorter than the predetermined time T, the belt correction sequence is not carried out.

In the belt correction sequence shown in FIG. 19, when the image forming apparatus is started, the control circuit portion 22 causes the drive means M of the fixing apparatus 21 to drive the pressure roller 202 to be rotated in a normal direction thereby to shift the belt 205 in the normal direction at a normal speed (100 mm/sec) by a predetermined amount and then to stop the belt. Further, power is supplied to the halogen heater lamps 228 and 229 to maintain the temperature of the belt 205 to about 180° C.

In this case, the predetermined shifting amount of the belt 205 corresponds to an amount during which the belt portion situated at the heating roller 226 upon starting the shifting movement of the belt and including the winding curl generated by the heating roller 226 is firstly entered into the nip portion N. In this condition, the belt portion including the winding curl generated by the heating roller 226 and positioned in the nip portion N is heated for about 8 seconds. As a result, the winding curl generated by the heating roller 226 is eliminated by the heating and the pressurizing in the nip portion N (iron effect).

Then, the control circuit portion 22 causes the drive means M to drive the pressure roller 202 to be rotated in the normal direction thereby to shift the belt 205 in the normal direction at a normal speed (100 mm/sec) by a predetermined amount and then to stop the belt. This predetermined shifting amount of the belt 205 corresponds to an amount during which the belt portion situated at the donor roller 224 upon starting the shifting movement of the belt and including the winding curl generated by the donor roller 224 is firstly entered into the nip portion N. In this condition, the belt portion including the winding curl generated by the donor roller 224 and positioned in the nip portion N is heated for about 8 seconds. Then, the power supply to the halogen lamps 228 and 229 is stopped, and the belt correction sequence is ended.

As a result, the winding curl generated by the donor roller 224 and the winding curl generated by the heating roller 226 are eliminated by the heating and the pressurizing in the nip portion N, thereby preventing the offset and image scattering of the fixed image.

Also in this embodiment, similar to the first embodiment, the control circuit portion 22 can detect the rotational shifting amount of the belt 205 on the basis of the feedback signal from the sensor 25 and can control the drive means M to shift the belt 205 at the predetermined speed by the predetermined amount. The predetermined amount and predetermined speed shifting movement of the belt 205 in the belt correction sequence is performed by this control.

Further, also according to the illustrated embodiment, in FIG. 2, in a case where, after the pre-multiple rotation process of the image forming apparatus is finished and the stand-by condition is established temporarily, the pre-rotation process is carried out on the basis of the image forming start signal, if the stand-by time exceeds the predetermined time T, the belt correction sequence is performed also in this pre-rotation process.

Fourth Embodiment

Figure 20:
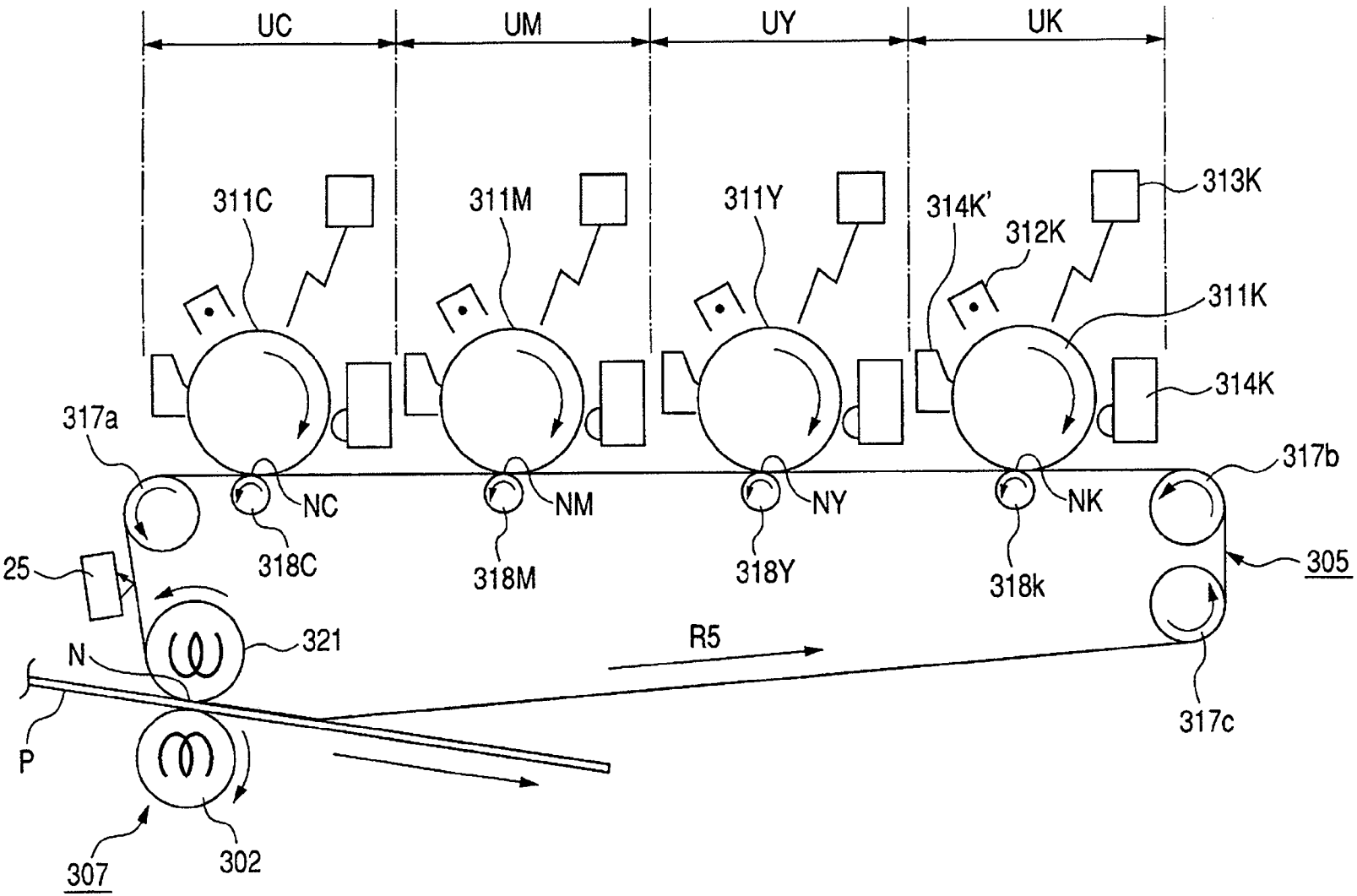
FIG. 20 is a schematic constructional view of an image forming apparatus according to a fourth embodiment of the present invention.

FIG. 20 is a longitudinal sectional view showing a schematic construction of an image forming apparatus according to a fourth embodiment of the present invention. This image forming apparatus is a four color full-color image forming apparatus in which four image forming units are disposed along a shifting direction of an intermediate belt as an intermediate transferring member (second image bearing member) and which performs transferring simultaneously fixing of a toner image on the intermediate belt at a secondary transferring portion.

The image forming apparatus includes four image forming units for forming different color toner images, i.e. a black image forming unit UK, a yellow image forming unit UY, a magenta image forming unit UM and a cyan image forming unit UC. These units have substantially the same construction and function, except for color difference.

The black image forming unit UK includes an electrophotographic photosensitive member of drum type (first image bearing member; referred to as "photosensitive drum" hereinafter) 311K as an image bearing member. The photosensitive 311K is constituted by providing a-Si (amorphous silicon) semiconductor on a surface of a drum-shaped aluminum base member. The photosensitive 311K is rotatingly driven by drive means (not shown) in a (clockwise) direction shown by the arrow. A charging device 312K is provided and is spaced apart from the photosensitive drum 311K. For example, a corona discharger can be used as the charging device 312K, which uniformly charges or electrifies the surface of the photosensitive 311K to predetermined polarity and predetermined potential. Exposure means 313K serves to expose the surface of the photosensitive 311K at a downstream side of the charging device 312K in a rotational direction of the photosensitive drum 311K. By such exposure, an electrostatic latent image is formed on the surface of the photosensitive drum 311K. A developing device 314K is disposed in adjacent to the photosensitive 311K at a further downstream side of the exposing position. The developing device 314K serves to develop the electrostatic latent image on the photosensitive 311K by applying black toner to the latent image. An intermediate transferring belt 305 as an intermediate transferring member is driven while being contacted with the photosensitive drum 311K. The intermediate transferring belt 305 is a flexible belt-shaped rotary member and is wound around first to third suspension rollers 317*a* to 317*c* and an upper heating roller 321 of a secondary transferring simultaneously fixing device 307 and is shifted (rotatingly driven) in a direction shown by the arrow R5. A primary transferring roller 318K is disposed at a primary transferring position in a confronting relationship to the photosensitive drum 311K with the interposition of the intermediate transferring belt 305. A primary transferring nip portion is denoted by NK.

Since the constructions and functions of the other three color image forming units are the same as those of the black image forming unit UK, explanation thereof will be omitted. 311Y, 318Y and NY denote a photosensitive drum, a primary transferring roller and a primary transferring nip portion, respectively, for the yellow color. Similarly, 311M, 318M and NM denote a photosensitive drum, a primary transferring roller and a primary transferring nip portion, respectively, for the magenta color. Further, 311C, 318C and NC denote a photosensitive drum, a primary transferring roller and a primary transferring nip portion, respectively, for the cyan color. A recording material (transferring material) such as a paper on which an image is to be formed is denoted by P.

Next, an operation of the image forming apparatus will be explained. In the image forming unit UK, the surface of the photosensitive drum 311K rotatingly driven by the drive means (not shown) in the direction shown by the arrow is uniformly charged by the charging device 312K to predetermined potential having minus polarity. After the charging, the electrostatic latent image is formed on the charged surface of the photosensitive 311K by the exposure device 313K on the basis of image information. The developing device 314K applies negatively-charged toner to the electrostatic latent image, thereby developing the latent image as the toner image. The toner image formed on the surface of the photosensitive 311K is primarily transferred onto the intermediate transferring belt 305 rotating in the direction R5 by an electric field of the transferring roller 318K at the primary transferring nip portion NK.

On the other hand, toner (residual toner) not primarily transferred to the intermediate transferring belt 305 and remaining on the photosensitive 311K is cleaned or removed by a cleaner 314K'.

The above-mentioned operations are also performed in the remaining three image forming units UY, UM and UC so that toner images are formed on the photosensitive drums 311Y, 311M and 311C, respectively. These toner images are primarily transferred successively onto the black toner image primarily transferred to the intermediate transferring belt 305 in a superimposed fashion. In this way, the black, yellow, magenta and cyan color toner images are primarily transferred onto the intermediate transferring belt 305 in the superimposed fashion. Incidentally, in case of a mono-color toner image or 2 to 3 color toner images, the selected color toner image(s) is/are formed on the intermediate transferring belt 305.

The plural color toner images on the intermediate transferring belt 305 are thermally secondarily-transferred onto the recording material P collectively by the secondary transferring simultaneously fixing device 307 at a secondary transferring nip portion N, and, at the same time, they are fixed onto the recording material P.

Figure 21:
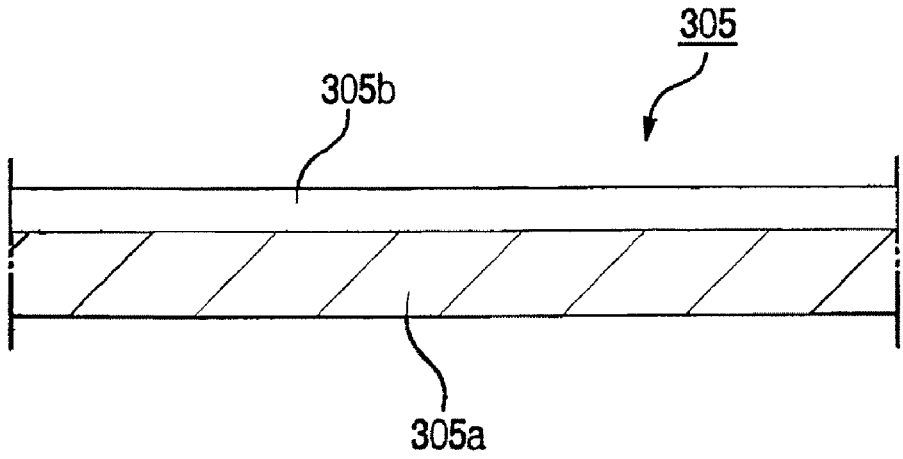
FIG. 21 is a schematic view showing a layer structure of an intermediate belt according to the fourth embodiment.

FIG. 21 is a schematic view showing a section of the intermediate transferring belt 305 used in this embodiment. The belt includes a film base layer (base film) 305*a* formed from heat resistive resin. As the heat resistive resin, for example, high heat resistive resin such as polyester, PET (polyethylene terephthalate), PFA (tetrafluoroethylene perfluoroalkyl vinylether copolymer), PTFE (polytetrafluoroethylene), polyphenylene sulfide, polyamideimide, polyimide, polyether-ether-ketone, liquid crystal polymer or the like, or metal sheet such as aluminum, nickel or the like, or composite material combining ceramic, metal or glass with them can be used.

A heat resistive surface layer (high mold releasing layer) 305*b* has a thickness of 5 μm, for example and is made of, for example, fluororesin such as PET, PFA or PTFE similar to the base layer 305*a* or fluororubber or silicone resin or silicone rubber.

Further, more preferably, the intermediate transferring belt 305 has whole volume specific resistance Rv of $10^5$ to $10^{15}$ Ω·m.

In the illustrated embodiment, in the intermediate transferring belt 305, a polyimide film having a thickness of 50 μm is used as the base layer (base film) 305*a*, and a PFA layer having a thickness of 5 μm and having low resistance obtained by dispersing carbon therein is coated on the surface of the base layer to form the surface layer (mold releasing layer) 305*b*.

Next, the secondary transferring simultaneously fixing device 307 will be explained. The secondary transferring simultaneously fixing device 307 includes a lower heating roller 302 and an upper heating roller 321. The lower heating roller 302 and the upper heating roller 321 incorporate heaters therein, respectively, and are opposed to each other with the interposition of the intermediate transferring belt 305. With this affangement, the nip portion N is formed between the intermediate transferring belt 305 and the lower heating roller 302. The lower heating roller 302 and the upper heating roller 321 serve to heat and pressurize the intermediate transferring belt 305 and the transferring material P fed from a sheet feeding portion (not shown) to the nip portion N in synchronous with the timing of the toner images on the intermediate transferring belt 305, thereby secondarily transferring and simultaneously fixing the plural color toner images on the intermediate transferring belt 305 collectively.

Figure 22:
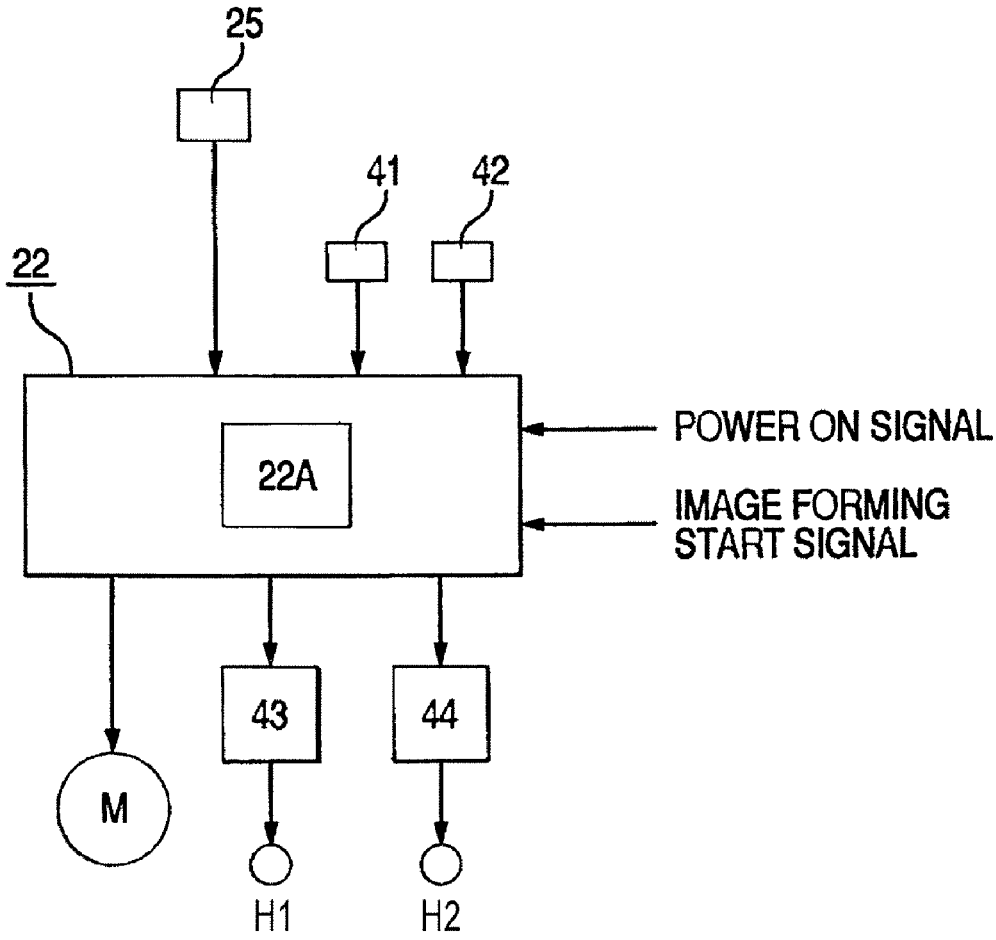
FIG. 22 is a block diagram of a control system a secondary transferring and simultaneously fixing apparatus according to the fourth embodiment.

FIG. 22 is a block diagram of a control system of the fixing apparatus. The control circuit portion (CPU) 22 serves to control power supply circuit portions 43 and 44 on the basis of temperature detection signals inputted from a temperature detecting device 41 for the upper heating roller 321 of the secondary transferring simultaneously fixing device 307 and from a temperature detecting device 42 for the lower heating roller 302 thereby to adjust electric powers to be supplied to heaters Hi and H2 incorporated into the upper heating roller 321 and the lower heating roller 302, thereby performing temperature adjustment of the temperatures of the upper heating roller 321 and the lower heating roller 302 to predetermined temperatures. Further, the control circuit portion 22 can detect a rotational shifting amount of the intermediate transferring belt 305 on the basis of a feedback signal from a sensor 25 for the intermediate transferring belt 305 and can control the drive means M for the intermediate transferring belt 305 to shift the intermediate transferring belt 305 at a predetermined speed by a predetermined amount.

(1) Belt Correction Sequence

In the illustrated embodiment, since the intermediate transferring belt 305 is wound around the first to third suspension rollers 317*a*, 317*b* and 317*c*, if the apparatus is left as it is more than a predetermined time, winding curls due to these rollers are generated. If the winding curl portion passes through the primary transferring portion, poor transferring will occur and/or poor image such as transferring void in the winding curl portion will occur.

To cope with this, in the illustrated embodiment, after the image forming apparatus is continuously left as it is for a predetermined time T in the inoperative condition, when the apparatus is used again, by performing the following belt correction sequence, the winding curls of the intermediate transferring belt 305 generated by the first to third suspension rollers 317*a*, 317*b* and 317*c* are eliminated quickly, thereby preventing occurrence of poor image.

Figure 23:
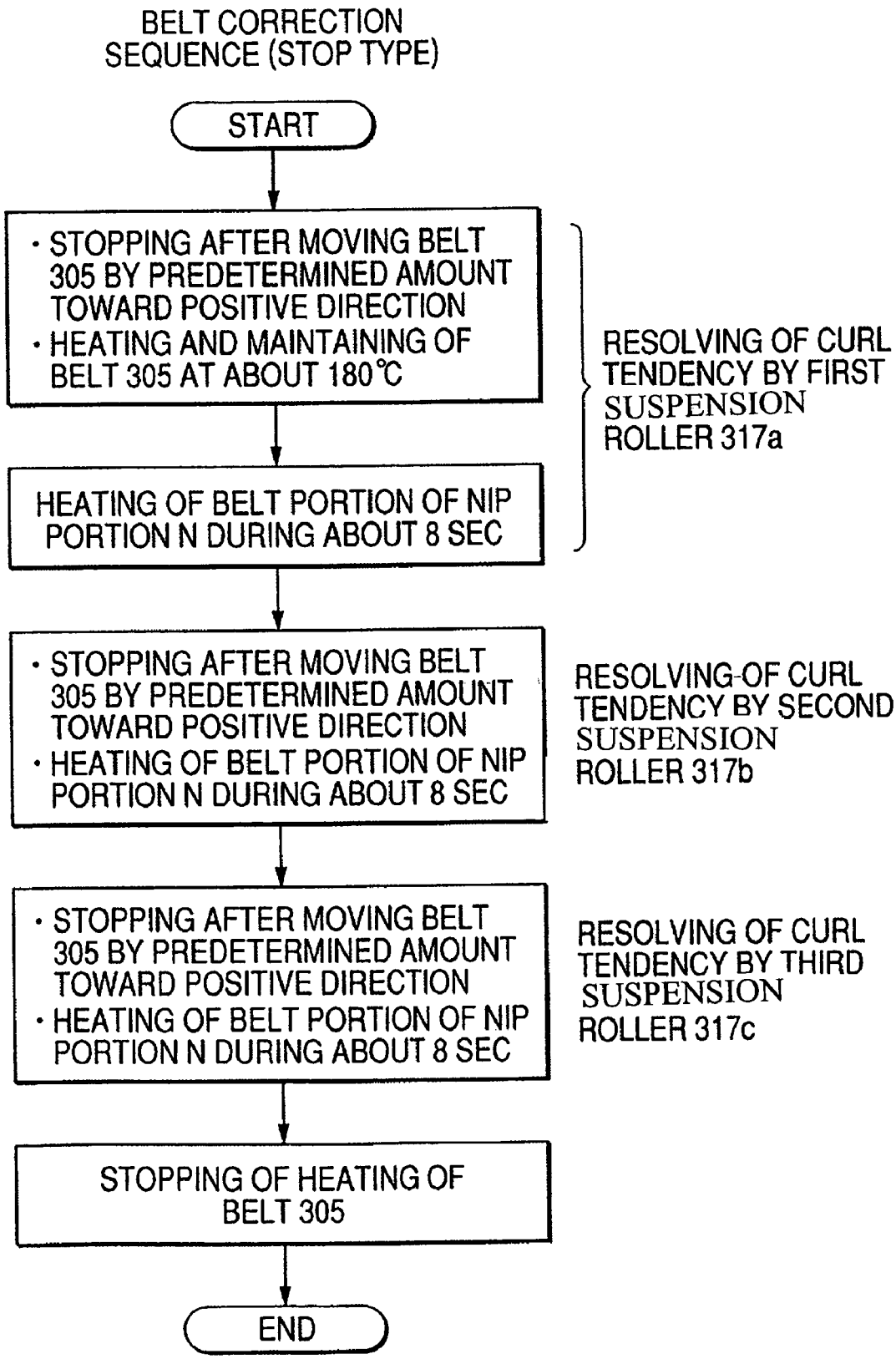
FIG. 23 is a flow chart of a belt correction sequence in the fourth embodiment.

Similar to the first embodiment, when the image forming apparatus is started by apparatus power ON, if the timer function portion 22A detects the fact that the continuous stop time of the apparatus between the finish time of the previous operation of the apparatus and the start time of new operation of the apparatus exceeds the predetermined time T, the control circuit portion 22 carries out the belt correction sequence (stop type) shown in FIG. 23 in the pre-multiple rotation process. If the continuous stop time is shorter than the predetermined time T, the belt correction sequence is not carried out.

In the belt correction sequence shown in FIG. 23, when the image forming apparatus is started, the control circuit portion 22 causes the drive means M to drive the intermediate transferring belt 305 to be rotated in a normal direction thereby to shift the intermediate transferring belt 305 in the normal direction at a normal speed by a predetermined amount and then to stop the belt. Further, power is supplied to the heaters H1 and H2 of the upper heating roller 321 and the lower heating roller 302 of the secondary transferring simultaneously fixing device 307 to heat and maintain the temperature of the intermediate transferring belt portion in the nip portion N to about 180° C.

In this case, the predetermined shifting amount of the intermediate transferring belt 305 corresponds to an amount during which the belt portion situated at the first suspension roller 317*a* upon starting the shifting movement of the belt and including the winding curl generated by the roller 317*a* is firstly entered into the nip portion N. In this condition, the belt portion including the winding curl generated by the roller 317*a* and positioned in the nip portion N is heated for about 8 seconds. As a result, the winding curl generated by the roller 317*a* is eliminated by the heating and the pressurizing in the nip portion N (iron effect).

Then, the control circuit portion 22 causes the drive means M to drive the intermediate transferring belt 305 to be rotated in the normal direction thereby to shift the belt 305 in the normal direction at a normal speed by a predetermined amount and then to stop the belt.

In this case, this predetermined shifting amount of the intermediate transferring belt 305 corresponds to an amount during which the belt portion situated at the second suspension roller 317*b* upon starting the shifting movement of the belt and including the winding curl generated by the roller 317*b* is firstly entered into the nip portion N. In this condition, the belt portion including the winding curl generated by the roller 317*b* and positioned in the nip portion N is heated for about 8 seconds. As a result, the winding curl generated by the roller 317*b* is eliminated by the heating and the pressurizing in the nip portion N.

Then, the control circuit portion 22 causes the drive means M to drive the intermediate transferring belt 305 to be rotated in the normal direction thereby to shift the belt 305 in the normal direction at a normal speed by a predetermined amount and then to stop the belt.

In this case, this predetermined shifting amount of the intermediate transferring belt 305 corresponds to an amount during which the belt portion situated at the third suspension roller 317*c* upon starting the shifting movement of the belt and including the winding curl generated by-the roller 317*c* is firstly entered into the nip portion N. In this condition, the belt portion including the winding curl generated by the roller 317*c* and positioned in the nip portion N is heated for about 8 seconds. As a result, the winding curl generated by the roller 317*c* is eliminated by the heating and the pressurizing in the nip portion N.

Then, the power supply to the heaters H1 and H2 of the upper heating roller 321 and the lower heating roller 302 of the secondary transferring simultaneously fixing device 307 is stopped, and the belt correction sequence is ended.

As a result, the winding curls of the intermediate transferring belt 305 generated by the first to third suspension rollers 317*a*, 317*b* and 317*c* are eliminated by the heating and the pressurizing in the nip portion N, thereby preventing the transferring void due to the winding curls of the intermediate transferring belt 305.

Further, also according to the illustrated embodiment, in FIG. 2, in a case where, after the pre-multiple rotation process of the image forming apparatus is finished and the stand-by condition is established temporarily, the pre-rotation process is carried out on the basis of the image forming start signal, if the stand-by time exceeds the predetermined time T, the belt correction sequence is performed also in this pre-rotation process.

Incidentally, in the first, third and fourth embodiments, in place of the belt correction sequence of belt stop type, the belt correction sequence of belt speed reduction type as shown in the second embodiment may also be applied. Further, in the second embodiment, in place of the belt correction sequence of belt speed reduction type, the belt correction sequence of belt stop type as shown in the first, third and fourth embodiments may also be adopted.

According to the embodiments mentioned above, by heating the belt portions including the bending marks or the winding curls generated by the long term inoperative condition of the apparatus in the nip portion or by heating such belt portions while passing through the nip portion at the low speed, such bending marks or winding curls can be eliminated quickly by the iron effect, without requiring long term idle rotation, thereby preventing glossy unevenness and streaks on the image caused by the belt bending marks or the belt winding curls.

This application claims priority from Japanese Patent Application No. 2004-358639 filed Dec. 10, 2004, which is hereby incorporated by reference herein.

What is claimed is:

1. An image heating apparatus comprising:

an endless belt for heating an image on a recording material at a nip;

supporting means for rotatably supporting said belt;

nip forming means for forming the nip between said belt and said nip forming means; and heating means for heating a portion of said belt located in the nip, wherein said apparatus is operable in a mode for performing heating process in a condition that a portion of said belt supported by said supporting means is shifted into the nip and stopped therein.

2. An image heating apparatus according to claim 1, wherein, if a stop time of said belt exceeds a predetermined time, said mode is carried out automatically.

3. An image heating apparatus according to claim 1, wherein said supporting means include a supporting member for supporting said belt at the nip.

4. An image heating apparatus according to claim 3, wherein said nip forming means function as said heating means.

5. An image heating apparatus according to claim 1, wherein said supporting means include a sliding member slidable with said belt with movement of said belt, and said sliding member functions as said heating means.

6. An image heating apparatus according to claim 1, wherein said belt is provided to be contacted with the image on said recording material.

7. An image heating apparatus comprising:

an endless belt for heating an image on a recording material at a nip;

supporting means for rotatably supporting said belt;

nip forming means for forming the nip between said belt and said nip forming means; and heating means for heating a portion of said belt located in the nip, wherein said apparatus is operable in a mode for correcting deformation of said belt by heating, in the nip, a portion of said belt deformed by said supporting means.

* * * * *

UNITED STATES PATENT AND TRADEMARK OFFICE

CERTIFICATE OF CORRECTION

PATENT NO. : 7,308,215 B2
APPLICATION NO. : 11/288087
DATED : December 11, 2007
INVENTOR(S) : Osamu Watanabe It is certified that error appears in the above-identified patent and that said Letters Patent is hereby corrected as shown below:

IN THE DRAWINGS
Sheet 4, Fig. 5B, “BACKT” should read --BACK--.

COLUMN 1
Line 42, “material being” should read --material is being--.

COLUMN 2
Line 67, “operable a” should read --operable in a--.

COLUMN 3
Line 10, “a” should read --in a--.

COLUMN 4
Line 3, “system a” should read --system of a--.
Line 20, “B:” should read --BL--.
Line 30, “affow.” should read --arrow.--.
Line 63, “matenal,” should read --material,--.

COLUMN 5
Line 5, “transfeffed” should read --transferred--.
Line 57, “till” should read --until--.

COLUMN 6
Line 62, “synchronous” should read --synchrony--.

COLUMN 7
Line 27, “nim)” should read --mm)--.
Line 54, “is” should read --are--.

COLUMN 10
Line 35, “tries” should read --try--.

UNITED STATES PATENT AND TRADEMARK OFFICE

CERTIFICATE OF CORRECTION

PATENT NO. : 7,308,215 B2
APPLICATION NO. : 11/288087
DATED : December 11, 2007
INVENTOR(S) : Osamu Watanabe It is certified that error appears in the above-identified patent and that said Letters Patent is hereby corrected as shown below:

COLUMN 11
Line 35, “plat” should read --plate--.
Line 39, “plat” should read --plate--.
Line 41, “plat” should read --plate--.
Line 45, “an” should read --a--.

COLUMN 12
Line 38, “mat” should read --may--.

COLUMN 13
Line 12, “Preferably” should read --preferably--.

COLUMN 15
Line 5, “amount-corresponds” should read --amount corresponds--.

COLUMN 16
Line 7, “roller 226” should read --roller 206--.

COLUMN 17
Line 16, “electromagnet” should read --electromagnetic--.
Line 19, “roller 226 during the” should read --roller 206 during which the--.
Line 36, “nous” should read --ny--.

COLUMN 18
Line 12, “roller 226” should read --roller 206--.
Line 17, “cause” should read --occur--.
Line 23, “226” should read --206--.
Line 56, “226” should read --206--.

UNITED STATES PATENT AND TRADEMARK OFFICE

CERTIFICATE OF CORRECTION

PATENT NO. : 7,308,215 B2
APPLICATION NO. : 11/288087
DATED : December 11, 2007
INVENTOR(S) : Osamu Watanabe It is certified that error appears in the above-identified patent and that said Letters Patent is hereby corrected as shown below:

COLUMN 19
Line 15, “roller 226” should read --roller 206--.
Line 17, “roller 226” should read --roller 206--.
Line 19, “roller 226” should read --roller 206--.
Line 21, “roller 226” should read --roller 206--.
Line 40, “roller 226” should read --roller 206--.

COLUMN 22
Line 1, “affangement,” should read --arrangement,--.
Line 7, “in” should be deleted.
Line 20, “Hi” should read --H1--.

COLUMN 23
Line 42, “by-the” should read --by the--.

Signed and Sealed this

Tenth Day of February, 2009

JOHN DOLL
*Acting Director of the United States Patent and Trademark Office*